US012742262B2

(12) United States Patent
Lundin et al.

(10) Patent No.: US 12,742,262 B2
(45) Date of Patent: Sep. 22, 2026

(54) POLYMER FIBERS WITH SHEAR-THICKENING LIQUID CORES

(71) Applicant: The Government of the United States of America, as represented by the Secretary of the Navy, Arlington, VA (US)

(72) Inventors: Jeffrey G. Lundin, Burke, VA (US); Michael J. Bertocchi, Alexandria, VA (US); Robert B. Balow, Mount Ranier, MD (US); James H. Wynne, Alexandria, VA (US)

(73) Assignee: The Government of the United States of America, as represented by the Secretary of the Navy, Arlington, VA (US)

( * ) Notice: Subject to any disclaimer, the term of this patent is extended or adjusted under 35 U.S.C. 154(b) by 1089 days.

(21) Appl. No.: 16/780,242

(22) Filed: Feb. 3, 2020

(65) Prior Publication Data

US 2020/0248338 A1 Aug. 6, 2020

Related U.S. Application Data

(60) Provisional application No. 62/799,951, filed on Feb. 1, 2019.

(51) Int. Cl.
*D01F 8/14* (2006.01)
*D01D 5/00* (2006.01)
(Continued)

(52) U.S. Cl.
CPC ..... *D01F 8/14* (2013.01); *D01D 5/0007* (2013.01); *D01F 1/02* (2013.01); *D01F 8/16* (2013.01);
(Continued)

(58) Field of Classification Search
CPC ..... D01F 8/14; D01F 1/02; D01F 8/16; D01F 1/10; D01F 8/04–16; D01F 8/00–18;
(Continued)

(56) References Cited

U.S. PATENT DOCUMENTS

2012/0115383 A1* 5/2012 Aasgaard ..... A47G 9/0207 428/399
2013/0068692 A1* 3/2013 Thomas ..... B01J 20/26 210/660
(Continued)

FOREIGN PATENT DOCUMENTS

CN 107215046 A * 9/2017 ..... B32B 5/02
KR 10-2012-0089089 A 8/2012
(Continued)

OTHER PUBLICATIONS

English translation of KR 20120108390 A obtained from Espacenet (Year: 2012).*
(Continued)

*Primary Examiner* — Braelyn R Watson
(74) *Attorney, Agent, or Firm* — US Naval Research Laboratory; Joseph T. Grunkemeyer

(57) ABSTRACT

Disclosed is a fiber having a solid sheath and a liquid core. The liquid core has shear-thickening viscosity. Also disclosed is a method of electrospinning the fiber. The fiber may be useful for mechanical and sound damping.

9 Claims, 25 Drawing Sheets

(51) Int. Cl.
*D01F 1/02* (2006.01)
*D01F 8/16* (2006.01)

(52) U.S. Cl.
CPC .... *D10B 2331/041* (2013.01); *D10B 2331/06* (2013.01); *D10B 2403/0333* (2013.01); *D10B 2503/04* (2013.01)

(58) Field of Classification Search
CPC ..... D01D 5/0007; D10B 2331/041; D10B 2331/06; D10B 2403/0333; D10B 2503/04
USPC ..... 442/200, 364; 428/399
See application file for complete search history.

(56) References Cited

U.S. PATENT DOCUMENTS

2013/0214457 A1 8/2013 David et al.
2016/0108194 A1* 4/2016 Topolkaraev ..... C08J 5/04 521/134

FOREIGN PATENT DOCUMENTS

KR 10-2012-0108390 A 10/2012
KR 20120108390 A * 10/2012 ..... D01D 5/34
WO 2008-115636 A2 9/2008

OTHER PUBLICATIONS

Composition, Vocabulary.com, 2023. (Year: 2023).*
Afshari, Mehdi. (2017). Electrospun Nanofibers—21.1 Introduction to 21.9 Conclusion. Elsevier (Year: 2017).*
Celanese Acetate, Complete Textile Glossary, p. 106, 2001. (Year: 2001).*
Nanofiber, Wikipedia, 2023. (Year: 2023).*
Pursuit, Everything You've Ever Wanted to Know About Body Armor and Protective Clothing, Mar. 8, 2012 (Year: 2012).*
Shu, Kewei, et al. "Electrolytes with reversible switch between liquid and solid phases." Current Opinion in Electrochemistry 21 (2020): 297-302. (Year: 2020).*
RheoSense, Viscosity of Newtonian and Non-Newtonian Fluids, p. 2, 2023. (Year: 2023).*
English translation of CN 107215046 A obtained by Global Dossier (Year: 2017).*
Li, Shan, et al. "Effect of shear thickening fluid on the sound insulation properties of textiles." Textile Research Journal 84.9 (2014): 897-902. (Year: 2014).*
Bertocchi et al., "Enhanced Mechanical Damping in Electrospun Polymer Fibers with Liquid Cores: Applications to Sound Damping" ACS Appl. Polym. Mater. 2019, 1, 2068?2076.
Enz et al., "Electrospun microfibres with temperature sensitive iridescence from encapsulated cholesteric liquid crystal" J. Mater. Chem., 2010, 20, 6866-6872.
Hufenus et al., "Melt-spun polymer fibers with liquid core exhibit enhanced mechanical damping" Materials and Design 110 (2016) 685-692.
Search Report and Written Opinion in PCT/US2020/016378 (May 29, 2020).

* cited by examiner

POLYMER FIBERS WITH SHEAR-THICKENING LIQUID CORES

This application claims the benefit of U.S. Provisional Application No. 62/799,951, filed on Feb. 1, 2019. The provisional application and all other publications and patent documents referred to throughout this nonprovisional application are incorporated herein by reference.

TECHNICAL FIELD

The present disclosure is generally related to composite fibers.

DESCRIPTION OF RELATED ART

The design and fabrication of composite fibrous materials with multifunctional interior core structures is increasingly attractive because the incorporation of different interiors allow for novel mechanical, optical, and chemical properties.[1-6] It has been shown that hybrid core-sheath fibers which incorporate interiors that contain liquids,[7-8] nanoparticles,[9] immiscible polymers,[10-11] or those that are hollow,[12-13] exhibit specific desired properties that are otherwise unattainable.[1-6] These materials have been employed in several applications such as drug delivery, sensors, gas storage, and actuation.[1-2, 6, 14] Although several promising candidates have emerged,[15-24] the development of hybrid core-sheath fibers remains a challenge because of the limited number of available techniques and materials to synthesize such composites.

Recently, several different approaches have been developed to fabricate core-sheath fibers with functional interior structures, most notably by either drawing[15, 25-27] or spinning.[17-20, 28-33] Among them, electrospinning has been found to be the most promising method because it can generate large quantities of fibers which have interconnected porosity, large surface-to-volume ratios, and high specific surface area.[34-37] A recent modification of traditional electrospinning is by using a coaxial spinneret.[38-40] In coaxial electrospinning, two components are spun simultaneously from a single spinneret in which the solutions emerge out of separate compartments with a concentric core-sheath (or layered) morphology. This arrangement allows the fibers to be functionalized with materials that are not spinnable on their own. Some examples include liquid crystals,[7, 41-43] nanoparticles,[18, 44] small-molecule drugs,[45-46] and live cells.[23] Still, the details of coaxial electrospinning are highly complex and the current understanding of the process is insufficient.[15] Thus, the aforementioned limiting factors (material selection and synthesis techniques) have compounded the difficulty in the development of liquid-filled fibers. To date, mechanical actuation of composite fibers with liquid cores has been suggested but remain relatively unexplored.

Non-Newtonian, shear-thickening fluids exhibit increased viscosity with increasing applied strain. Several physical descriptions exist to explain shear-thickening, most of which involve the confinement of viscous liquids or concentrated suspensions of particles in a viscous medium.[47-48] A rather common example of this behavior is found in layers of Kevlar® in which PEG fluids containing suspensions of $SiO_2$ aggregates have been incorporated in between the layers to increase ballistic resilience.[49] Mechanical damping can also result from interfacial or boundary interactions between particles or viscous clusters with boundaries that are capable of causing a sudden, discontinuous increase in viscosity with applied strain (i.e., dynamic jamming).[47] A recent computational model has proposed that mechanical damping can be especially enhanced when a non-Newtonian liquid is confined between rigid substrates.[50] Thus, it is surmised that the jamming effect could apply similarly to electrospun core-sheath fibers because the liquid is encapsulated in a polymer sheath boundary.

Mechanically damping and Non-Newtonian materials have been employed in several unique applications because of their abilities to dissipate mechanical energy.[51-52] One application in which non-Newtonian and fiber materials overlap is sound damping. Indeed, it has been demonstrated that electrospun fibrous composites of polyvinylidenedifluoride[53-54] and polyacrylonitrile[55] attenuate sound similarly to traditional fibrous materials. However, their mechanism of sound reduction results from the irregular and difficult path through which air and sound are forced to travel and not from non-Newtonian interactions.[56] Thus, core-sheath fibers that contain either non-Newtonian liquids or viscous Newtonian liquids exhibit unique mechanical properties which have the potential to provide sound attenuation. Although sound attenuation with liquid-core, polymer-sheath fibers has been suggested,[24] their specific interactions with sound do not appear to have been investigated (e.g., frequency, power, and amplitude dependence).

BRIEF SUMMARY

Disclosed herein is a fiber comprising: a solid sheath and a liquid core. The liquid core has shear-thickening viscosity.

Also disclosed herein as a method comprising: electrospinning a fiber comprising a solid sheath and a liquid core. The liquid core has shear-thickening viscosity.

BRIEF DESCRIPTION OF THE DRAWINGS

A more complete appreciation will be readily obtained by reference to the following Description of the Example Embodiments and the accompanying drawings.

DETAILED DESCRIPTION OF EXAMPLE EMBODIMENTS

In the following description, for purposes of explanation and not limitation, specific details are set forth in order to provide a thorough understanding of the present disclosure. However, it will be apparent to one skilled in the art that the present subject matter may be practiced in other embodiments that depart from these specific details. In other instances, detailed descriptions of well-known methods and devices are omitted so as to not obscure the present disclosure with unnecessary detail.

Disclosed herein is sound attenuation via coaxial core-sheath electrospun fiber mats in which the cores of the poly(caprolactone) (PCL) fibers may be either a shear-thickening fluid (poly(ethylene glycol)-200 containing $SiO_2$ particles) or other Newtonian PEG-based liquids. The fibrous mats were characterized using microscopy, TGA, rheology, DMA and sound attenuation experiments. The most probable sound attenuation mechanisms is discussed and a model for the observations is presented, which is supported by the prevailing opinions for enhanced damping behavior of core-sheath fibers containing liquid cores. Overall, comprehensive analyses of core-sheath fibers with liquid cores and show their utility for vibrational and acoustic sound damping are provided.

The fiber can exhibit unique and dynamic mechanical properties, i.e., its flexibility and rigidity is changed in response to mechanical oscillation. Potential applications are fiber-based dynamic body armor/protective equipment, selective hearing protection (selectively block loud sounds), and tunable sound attenuation.

Figure 1:
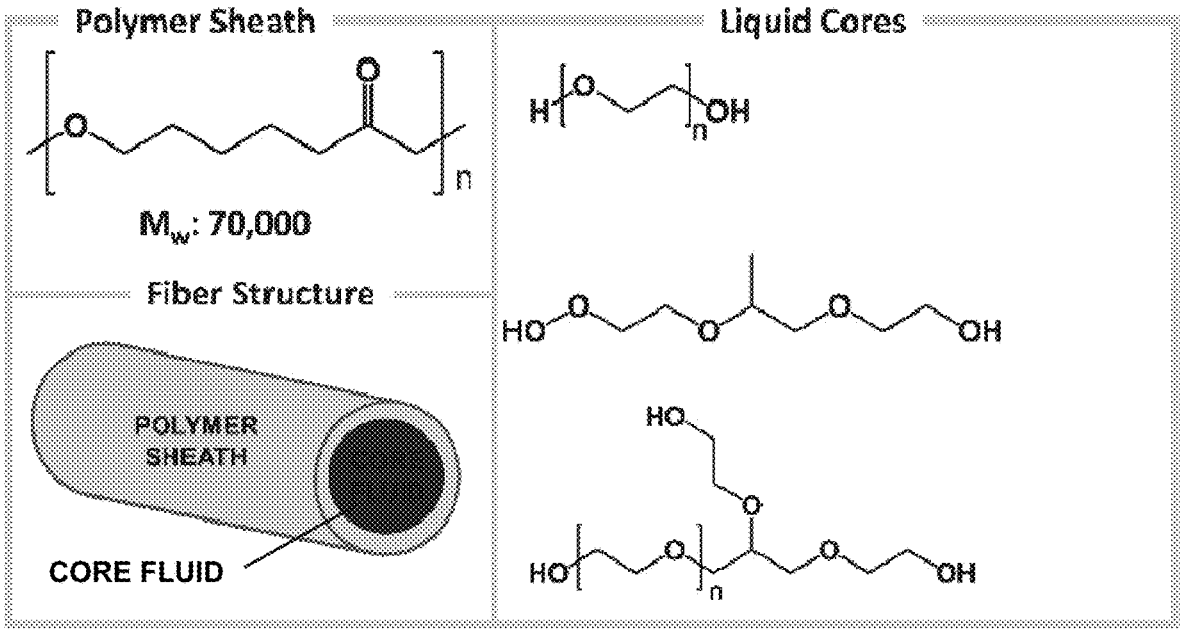
FIG. 1 shows chemical structures of the PCL polymer sheath and PEG fluids used as the liquid cores.

The fibers include a solid sheath and a liquid core that has shear-thickening viscosity. It is noted that the liquid in the core need not be shear-thickening when in bulk. The shear-thickening may arise from the liquid being within the core. Any pairing of solid and liquid that produces this result may be used. FIG. 1 shows example materials.

The following examples are given to illustrate specific applications. These specific examples are not intended to limit the scope of the disclosure in this application.

Materials—The polymer sheath solution was poly(caprolactone) (PCL, Scientific Polymer Products, Inc., Ontario, NY, USA; Mw=70,000) in dichloromethane (99%, Fisher). The core fluids were ethylene glycol (ETGLY, 99+%, Aldrich), glycerol ethoxylate (GLYETHOX1100, Mn=1100, Aldrich), poly(ethylene glycol)-block-poly(propylene glycol)-block-poly(ethylene glycol) (PEGPPG1100, Mn=1100, Aldrich), and poly(ethylene glycol)s with Mw values of 200 (PEG200, Alfa), 380-400 (PEG400, Fisher), 600 (PEG600, Aldrich). The shear thickening fluid was fumed silica, (avg. part. size=0.2-0.3 μm, Sigma) in PEG200. All reagents were reagent grade or better and used without further purification.

Solution Preparation Procedures—The PCL sheath solution was prepared by dissolving PCL into dichloromethane to achieve a final PCL concentration of 20 wt %. The core fluids were used neat. The shear thickening fluid was 9 wt % SiO2 particles in PEG 200 and was mixed prior to use on a speed mixer (Flacktek, Inc., Landrum, SC, USA) at 5000 rpm for 10 min.

Electrospinning Procedure—Coaxial electrospinning was performed on a custom built in-house apparatus which consisted of a 1 mL syringe filled with the PEG-based fluid and the other a 3 mL syringe containing the PCL solution. The syringes were placed on syringe pumps from New Era Pump Systems (Farmingdale, NY, USA; NE-300) and were attached with Tygon® tubing (Ramé-Hart, Succasunna, NJ, USA; 100-10-TYGON125) to a custom coaxial spinneret with an inner and outer needle (Ramé-Hart; inner needle i.d./o.d.=0.411/0.711 mm, outer needle i.d./o.d.=2.16/2.77 mm). The spinneret was attached to a high-voltage power supply from Bertan Associates (Spellman, Hauppauge, NY, USA; 205B) set at 15 kV and pointed downward to a grounded aluminum collection plate. The PCL sheath flow rate was set at 3.0 mL $hr^{-1}$. The core flow rate, as well as distance to grounded aluminum collection plate, were varied as described herein. The sheath composition, core materials, and coaxial fiber morphology are conceptualized in FIG. 1.

Optical Microscopy (OM)—A Zeiss Axio Imager 2 was used for optical imaging. Images were taken using EC Epiplan-Neofluar 5-50× objectives and processed using Zen Core software (Zeiss, Oberkochen, Germany). Samples were prepared on aluminum substrates or glass slides and were analyzed after 24 hours of air drying in either the reflection or transmission mode, respectively. The diameters of the fibers were measured using Image J software (National Institutes of Health, USA).

Mechanical Analysis—A TA Instruments Q800 (New Castle, DE, USA) in the uniaxial tension mode was used for dynamic mechanical analysis (DMA). Stress-strain measurements were acquired from 0 to 18 N with a ramp rate of 1 N $min^{-1}$ at 25° C. The oscillation measurements were acquired at 1% strain from 0 to 140 Hz, or until the fibers broke, and repeated twice. Note that in some cases, the Young's moduli of the fiber mats were measured beginning at the point in which the stress-strain curves bent upwards because of slack during the initial pulling. Stress was determined by applying the assumption that each fiber mat was of comparable cross-sectional density and porosity, as indicated by observations from optical microscopy.

Thermal Analysis—A TA Instruments Discovery (New Castle, DE, USA) Thermogravimetric Analyzer (TGA) was used for thermal analysis. Samples were heated from 50-700° C. at 10° C. $min^{-1}$ under a constant flow of $N_2$ at 50 mL $min^{-1}$ with an initial equilibration time of 5 min.

Rheological Measurements—A TA Instruments Discovery HR2 (New Castle, DE, USA) stress-controlled rheometer was used for rheological measurements with a 40 mm diameter cone (angle of 1°) and plate (stainless steel). Frequency sweeps were recorded in the range of 0.1-1000 rad $s^{-1}$ at 1% strain. The time sweeps were recorded at a constant angular frequency of 100 rad $s^{-1}$.

Sound Damping Experiments. A free-standing anechoic chamber (model USC26-101010) with rigid walls of nominal inside dimensions of 10.0' long×10.0' wide×9.5' high was used as the chamber for sound damping experiments. All of the chamber wall surfaces were covered with rigid wall sound absorption panels and was Radio Frequency-shielded. A Dynaudio Professional BM5A active speaker using a RME UFX audio interface played a series of test sounds consisting four separate sequences: consecutive one second test tones at ⅓ octave bands from 100 Hz to 5000 Hz (generated using a sine wave generator at a 44.1 kHz sampling rate using the Steinberg Cubase 8.5 software); two second pulses of white noise; two second pulse of pink noise (both white and pink noise generated using Steinberg Cubase 8.5 software); and a 10 sec logarithmic sine sweep from 16 Hz to 20,000 Hz, which was prepared to measure the full range of frequency attenuation. The test sounds were sent through a digital-to-analog converter with a linear frequency response (±0.5 dB) from 5 Hz-21.5 kHz and a signal to noise ratio of >110 dB RMS unweighted. All of the test tones and white noise were normalized to −3 dBfs. A 48 V phantom powered Oktava mk-012-01 condenser microphone with a relatively flat frequency response from 20-20,000 Hz was placed in a foam sleeve that extended 2.5 cm beyond the front capsule of the microphone. For each experiment, 4 electrospun mats (avg. thickness=0.18 ±0.02 mm) were cut into 4 $cm^2$ squares, stacked together, placed over the foam sleeve, and secured using t-pins. The electrospun mat covered microphone was placed 32.5 cm away from the BM5A speaker and pointed at the midpoint between the center of the tweeter and woofer. All sound damping experiments were performed in triplicate. The attenuated audio was recorded into Steinberg Cubase 8.5 software and exported as an uncompressed 16-BIT way file at 44.1 kHz sampling rate. The sound attenuation from the fiber mats was calculated by the percent difference between the total absolute integrated area of the recorded waveform with and without electrospun mats in front of the microphone using Originlab Origin 2018b software.

Morphological Studies—The electrospun fibers exhibited a concentric structure and a layered morphology typical of coaxial fibers. Representative images of the fibers collected on a glass slide are shown in FIGS. 2A-H. Different parameters such spinneret-to-collector separation distance and solution flow rate were investigated using single-phase PCL fibers (i.e., non-core-sheath fibers composed of neat PCL) (FIG. 2A) and core-sheath PCL fibers with PEG200 as the core fluid (FIGS. 2B-H). The average fiber diameters and distributions were measured from optical microscopy images (FIGS. 2I-L).

Figure 2A:
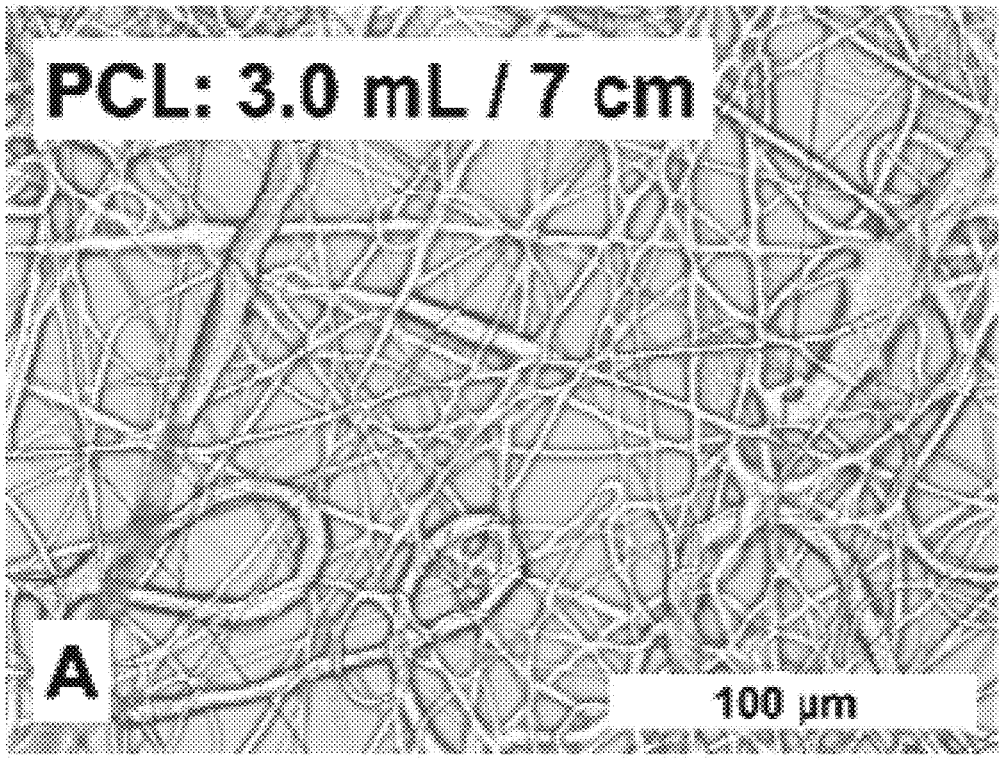
FIGS. 2A-L shows Optical microscopy images of PCL and PCL-PEG200 as a function of spinneret-to-collector separation distance and flow rate of PEG200 (FIGS. 2A-H). The fiber diameters for the various conditions are displayed in box plots where the dots each represent a single measurement and each box represents the average fiber diameter (center line) and standard deviation (top and bottom lines) of all measurements at the same flow rate (FIGS. 2I-L).
Figure 2B:
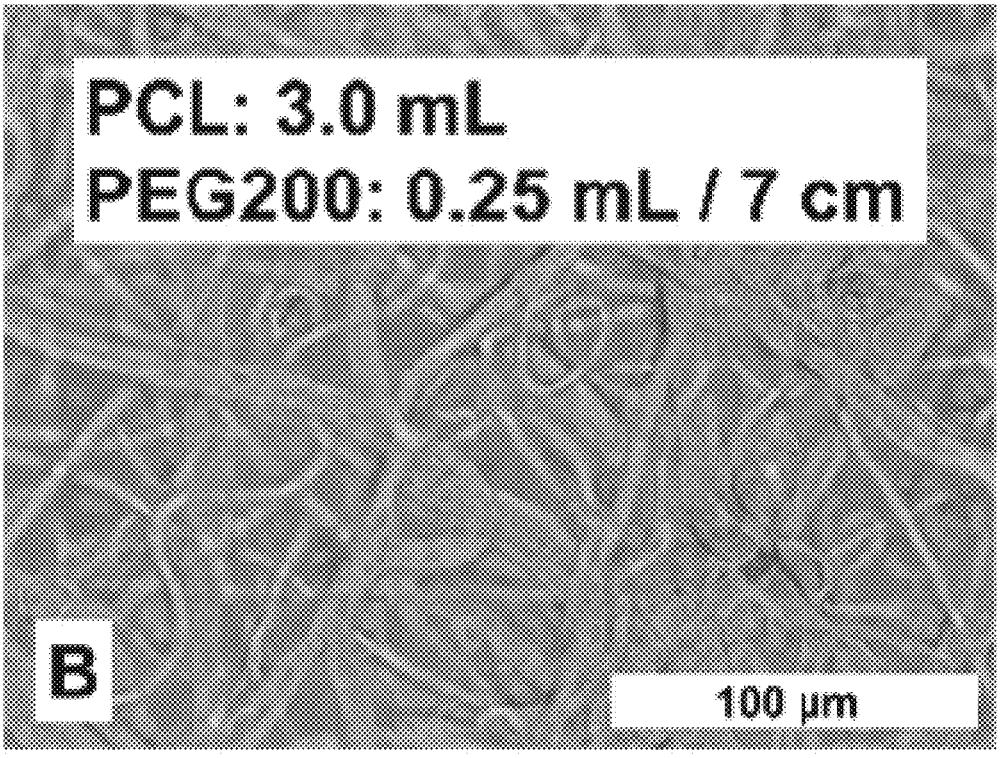
Figure 2C:
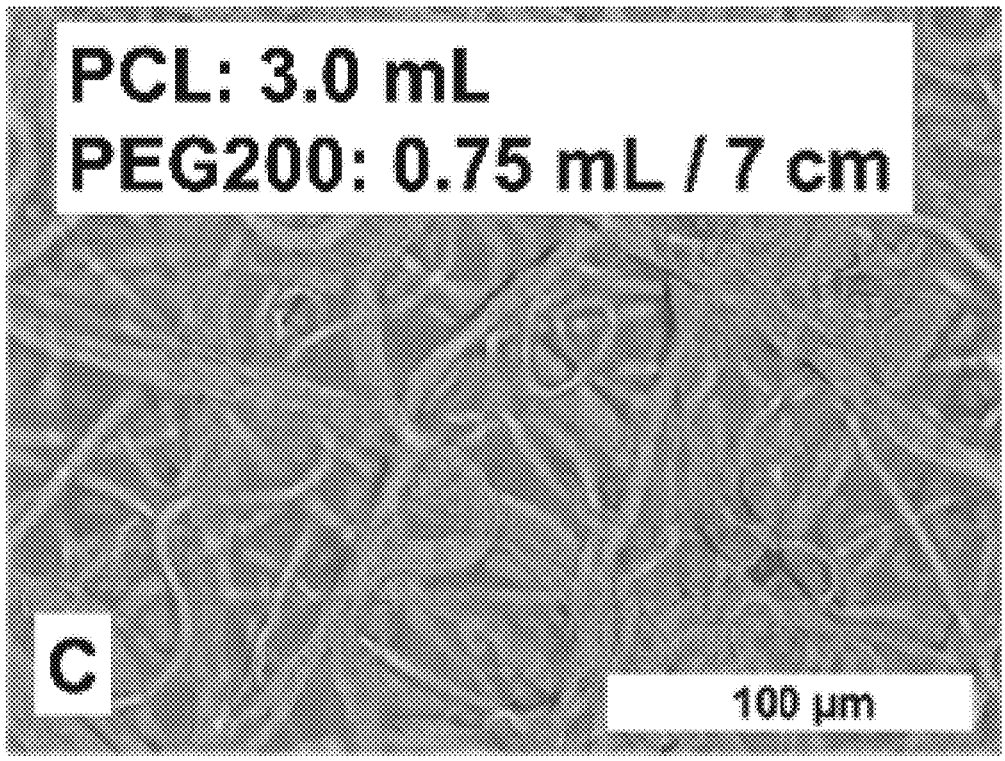
Figure 2D:
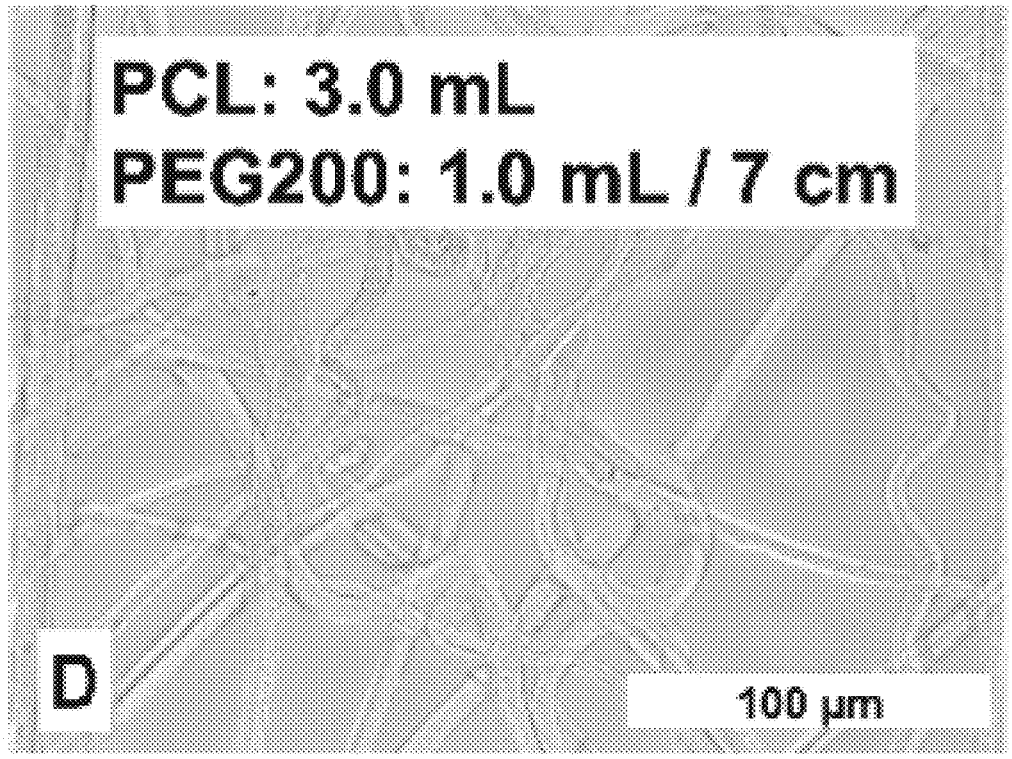
Figure 2E:
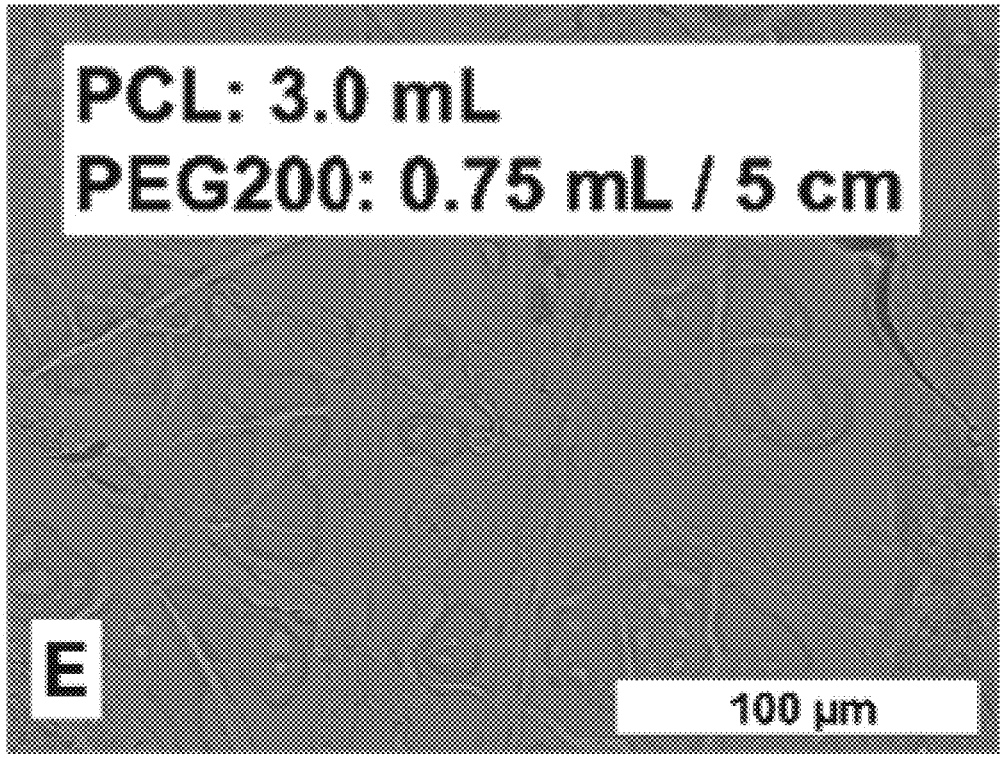
Figure 2F:
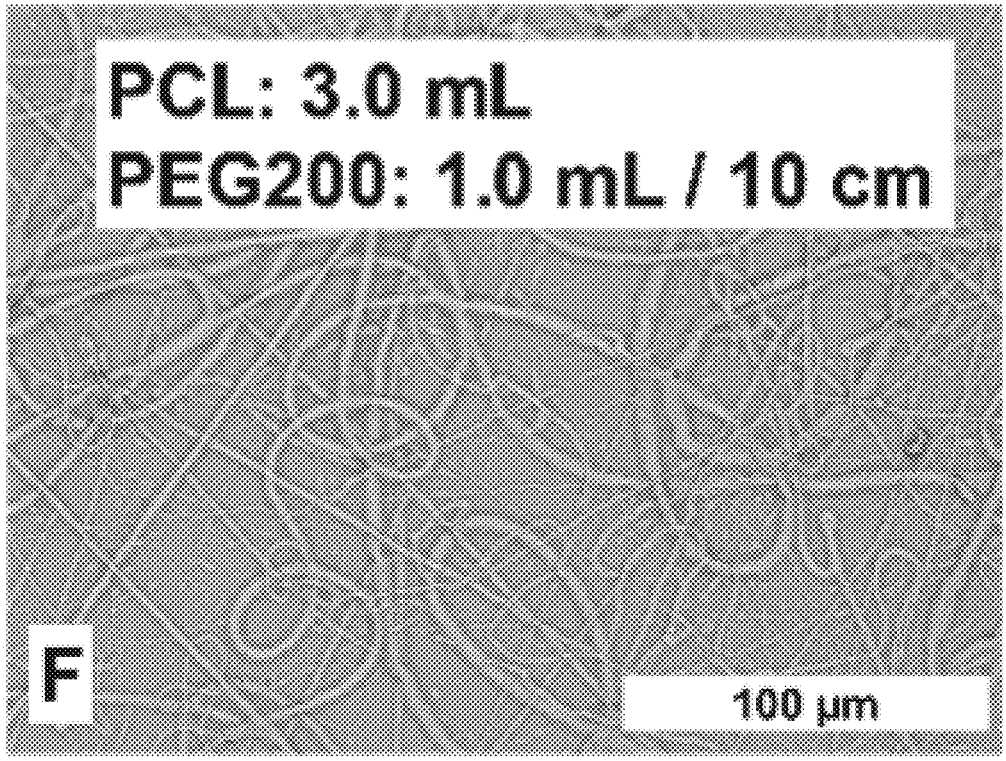
Figure 2G:
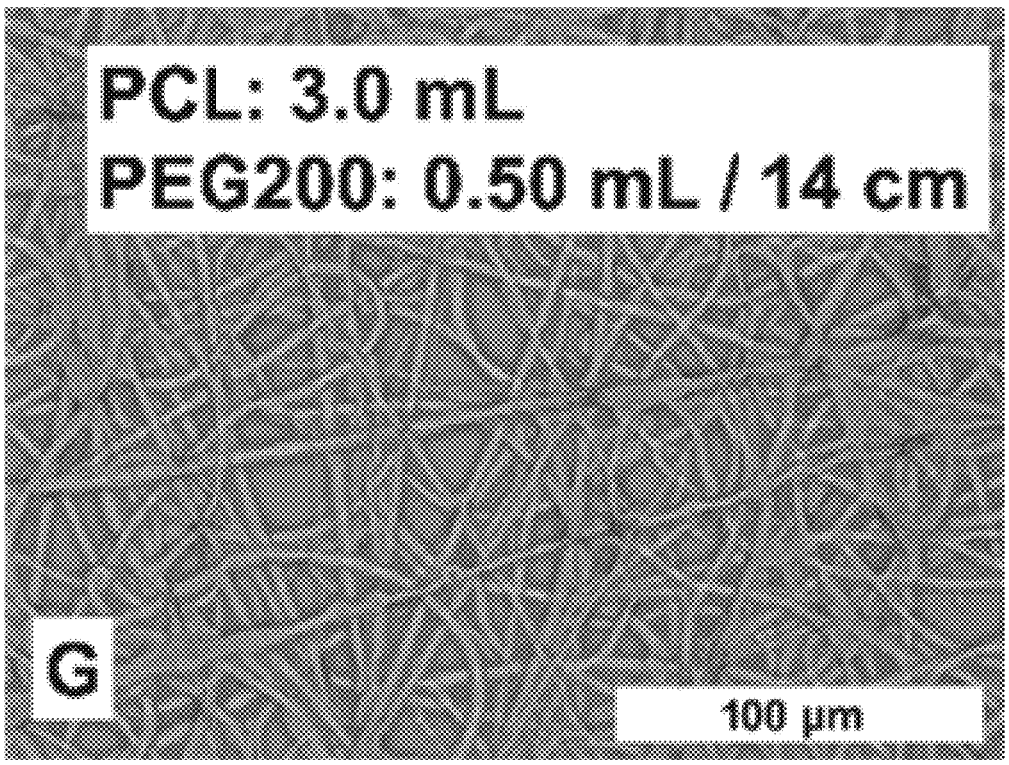
Figure 2H:
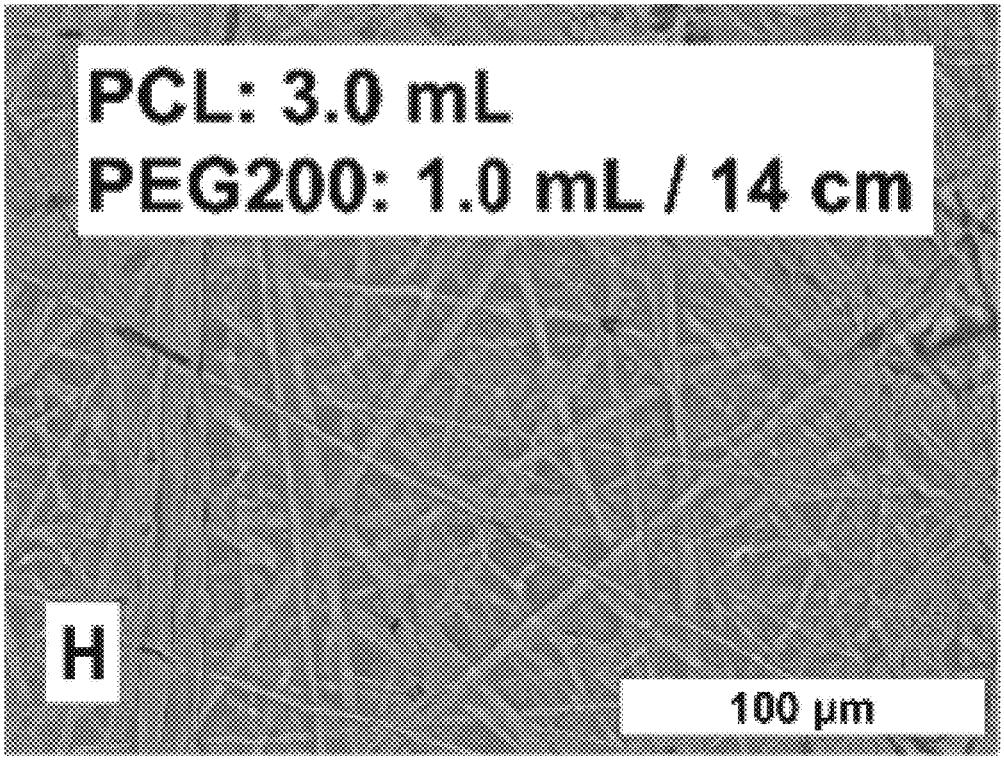
Figure 2I:
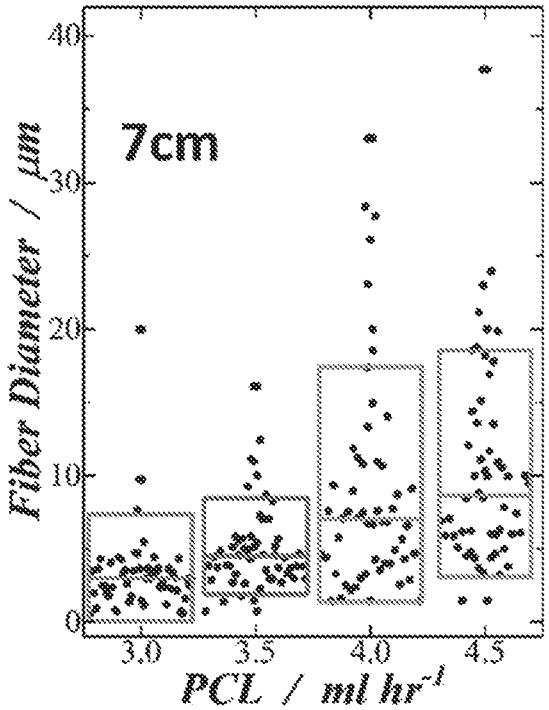
Figure 2J:
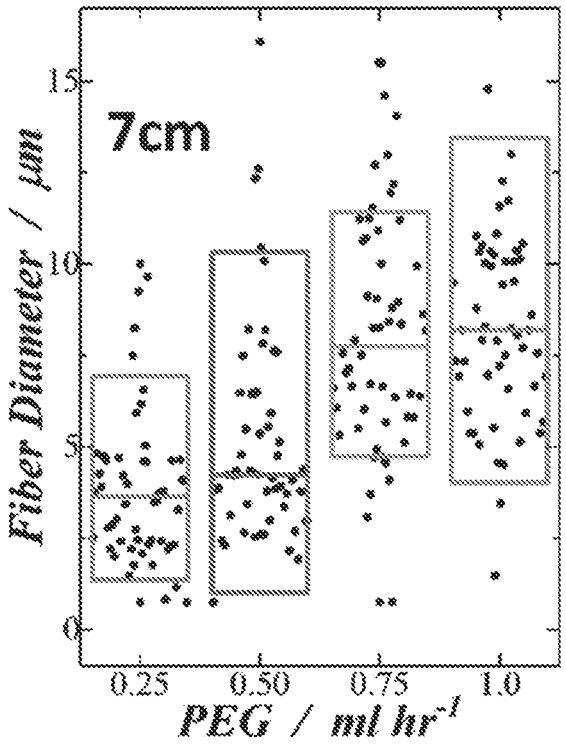

The fiber diameters of the single-phase PCL fibers increased linearly as the flow rate of the PCL solution was increased (FIG. 2I). An increase in the fiber diameters with increasing flow rate of single-phase PCL was expected because more polymer is ejected from the syringe per unit time. In the case of the core-sheath fibers (FIGS. 2A-H), the flow rate of the PCL sheath solution was kept at 3.0 mL $hr^{-1}$ throughout and the core flow rate varied between 0-1 mL $hr^{-1}$. As the core flow rate was increased, the diameter of the fibers became larger because of the increase in mass flow of the core liquid (FIGS. 2A-H). In fact, the diameters of the PCL-PEG200 fibers measured 7.7 and 8.2 μm at core flow rates of 0.75 and 1.0 mL $hr^{-1}$ and are more than double the diameters of the single-phase PCL fibers at the same separation distance (7 cm) and applied voltage (15 kV) (FIGS. 2I-J). None of the samples displayed merging of the fibers at their intersections, which indicates that virtually all of the carrier solvent had evaporated from the sheath solution prior to impact with the substrate and that the core fluid was encapsulated successfully.

Figure 2K:
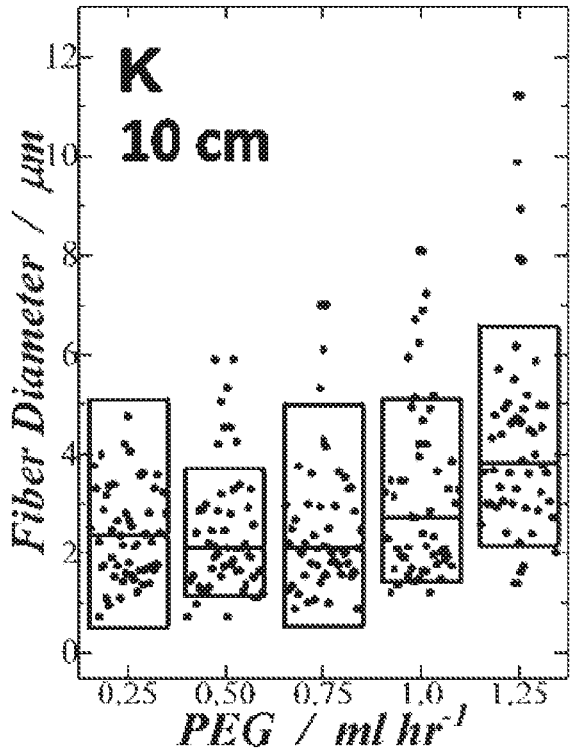
Figure 2L:
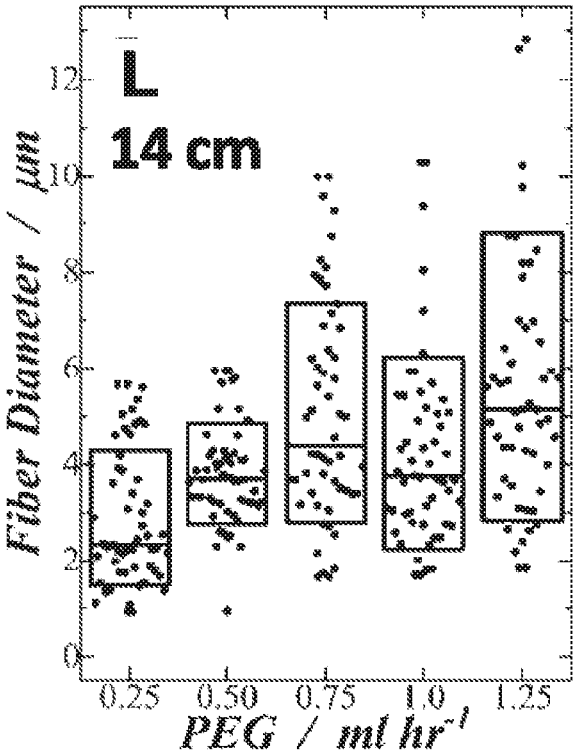
Figure 7:
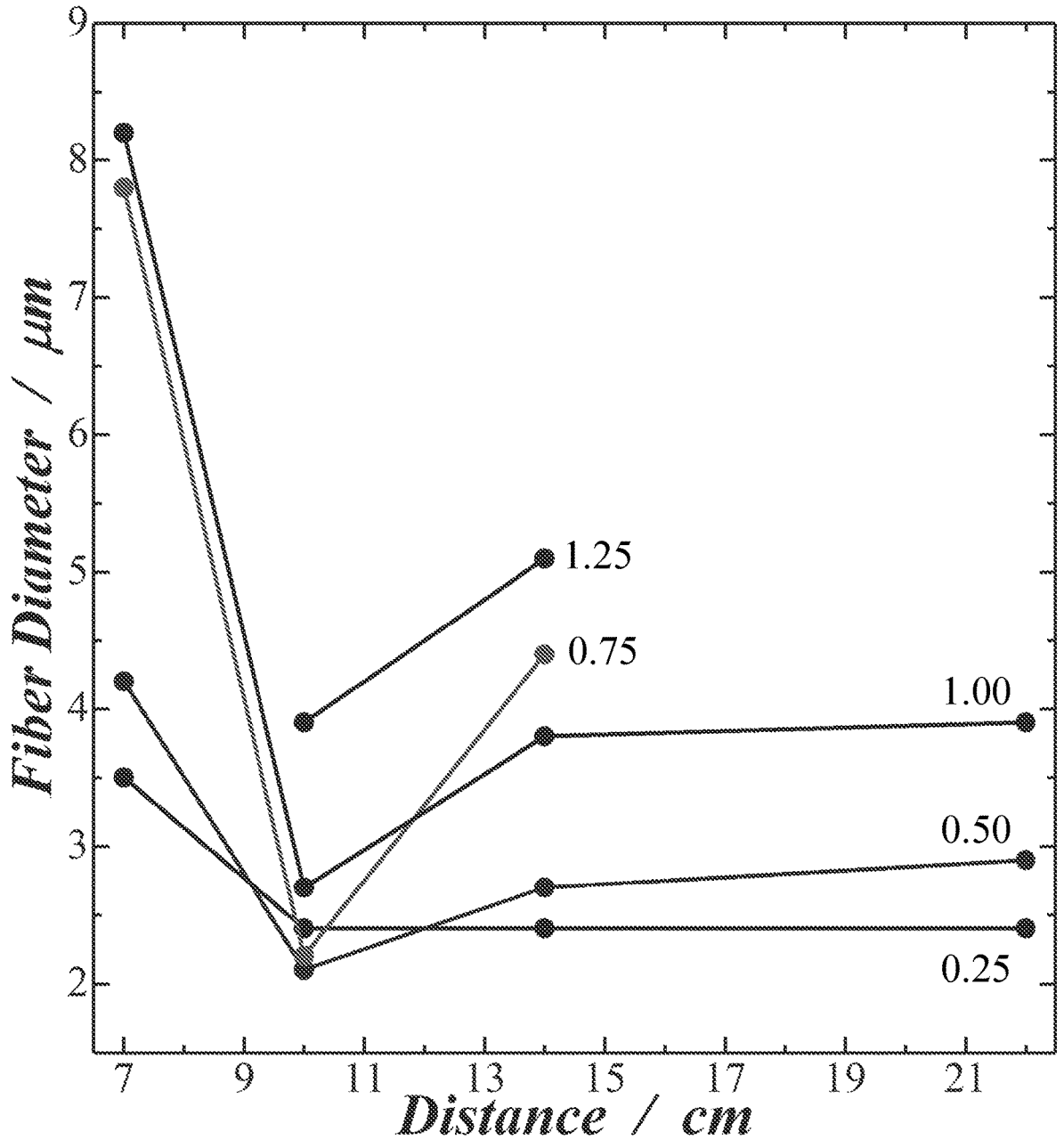
FIG. 7 shows a plot of fiber diameter as a function of collector-to-spinneret separation distance at different flow rates of PEG200. The flow rate of the polymer sheath solution was 3 mL $hr^{-1}$.

The effect of spinneret-to-collector separation distances (5-14 cm) on PCL-PEG200 fiber diameter was examined at a constant flow rate of PCL (3 mL $hr^{-1}$) and applied voltage (15 kV) (FIGS. 2J-L). The diameters of the fibers decreased as the spinneret-to-collector separation distance was increased; the decrease in fiber diameter is caused by increased whipping of the polymer jet due to Rayleigh instability and increased electrostatic forces from greater solvent evaporation[57-59]. At spinneret-to-collector separation distances beyond 10 cm, only minor changes in the fiber diameters were observed (FIG. 7). Thus, the 10 cm separation distance was used when spinning fibers for mechanical and sound damping analyses. Attempts were made to electrospin the core-sheath fibers at separation distances below 7 cm; however, optical microscopy revealed that the PEG leaked out of the fiber cores (FIG. 2E). At such a short distance, it was surmised that the dichloromethane carrier solvent for the PCL did not sufficiently evaporate prior to substrate impact and caused mixing of the core and sheath.

Figure 8:
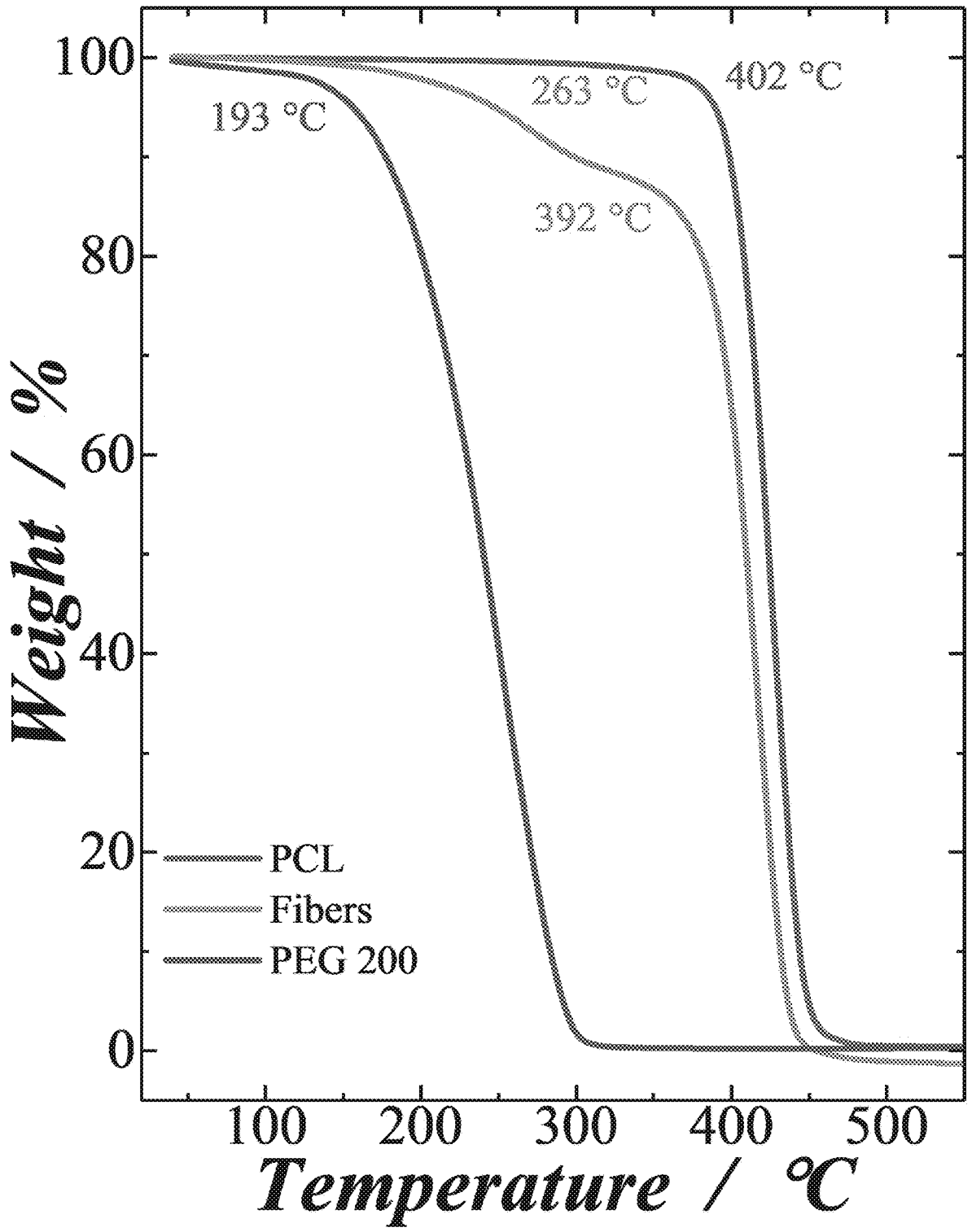
FIG. 8 shows thermogravimetric analyses of PCL, PEG200, and PCL-PEG200 electrospun fibers. Scans were collected at a heating rate of 10° C. $min^{-1}$.

Further confirmation of the core-sheath morphology was evidenced by the TGA thermograms and DMA measurements (vide infra). The TGA thermogram showed that the degradation onset temperature of the neat PCL fibers and neat PEG200 was 402° C. and 193° C., respectively. In core-sheath PCL-PEG200 fibers, the degradation onset temperature of PEG200 increased to 263° C. and the PCL exhibited a minor decrease to 392° C. The increase in degradation temperature of PEG200 is attributed to insulating effects via the containment of PEG200 provided by the PCL sheath, which effectively delays the evaporation of PEG200. The 10° C. decrease in PCL degradation temperature was likely due to greater porosity and surface area of the PCL sheath that resulted from vaporized PEG200 that disrupted its structure. Thus, the significant shift in the onset of degradation of PEG200 is indicative of its encapsulation in the cores of the fibers (FIG. 8).

Figure 3:
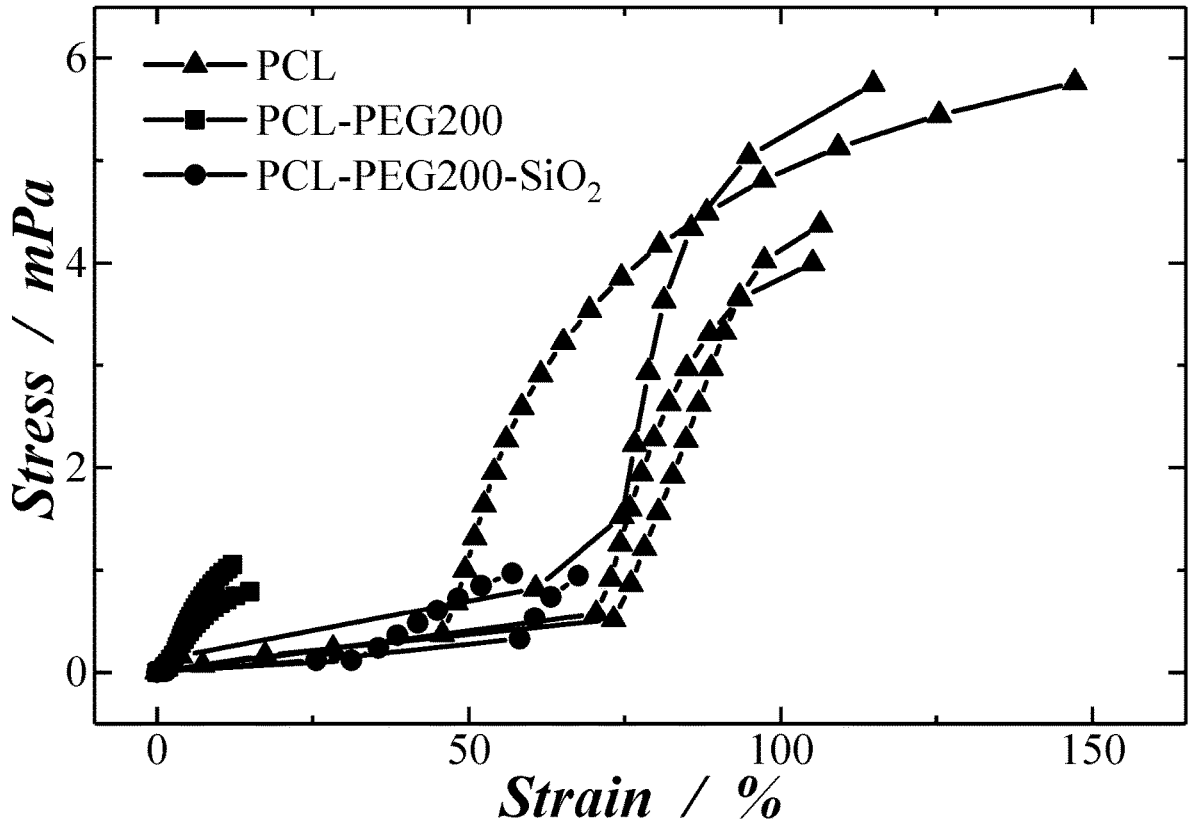
FIG. 3 shows DMA stress-strain curves of the electrospun fiber mats. The stress-strain curves were collected at a strain rate of 1 N $min^{-1}$ at 25° C. The lines with the same symbol are from multiple trials. The sheath and core flow rates were 3 and 1 ml $hr^{-1}$, respectively.

Mechanical Properties of the Fibers—The stress-strain curves of single-phase PCL fibers as non-woven mats and those with the cores as PEG200 or PEG-$SiO_2$ are shown in FIG. 3. Clearly, the ultimate tensile strength of the core-sheath fibers (0.7-1.0 mPa) is ca. 6-fold lower than that of the single-phase PCL fibers (4-6 mPa). A weakening in the ultimate tensile strength of the core-sheath fibers is expected because the liquid cores provide little, if any elastic behavior; this weakening is also indicated by a lower strain at break, which decreases as the liquids become less viscous. The core-sheath fibers also have a lower Young's modulus than the single-phase PCL fiber mats because the liquid cores make them less stiff. Note that the stress-strain curves of single-phase PCL fiber mats appears to have two slopes, which is indicative of the fiber mats being randomly orientated. The bend in the stress-stain curves of the fibers is a result of two components: tensile stretching of vertically aligned fibers and realignment of horizontal fibers to more vertical orientations along the direction of tension. This manifestation is likely convoluted in the core-sheath fibers because of the greater viscous component.

Figure 4A:
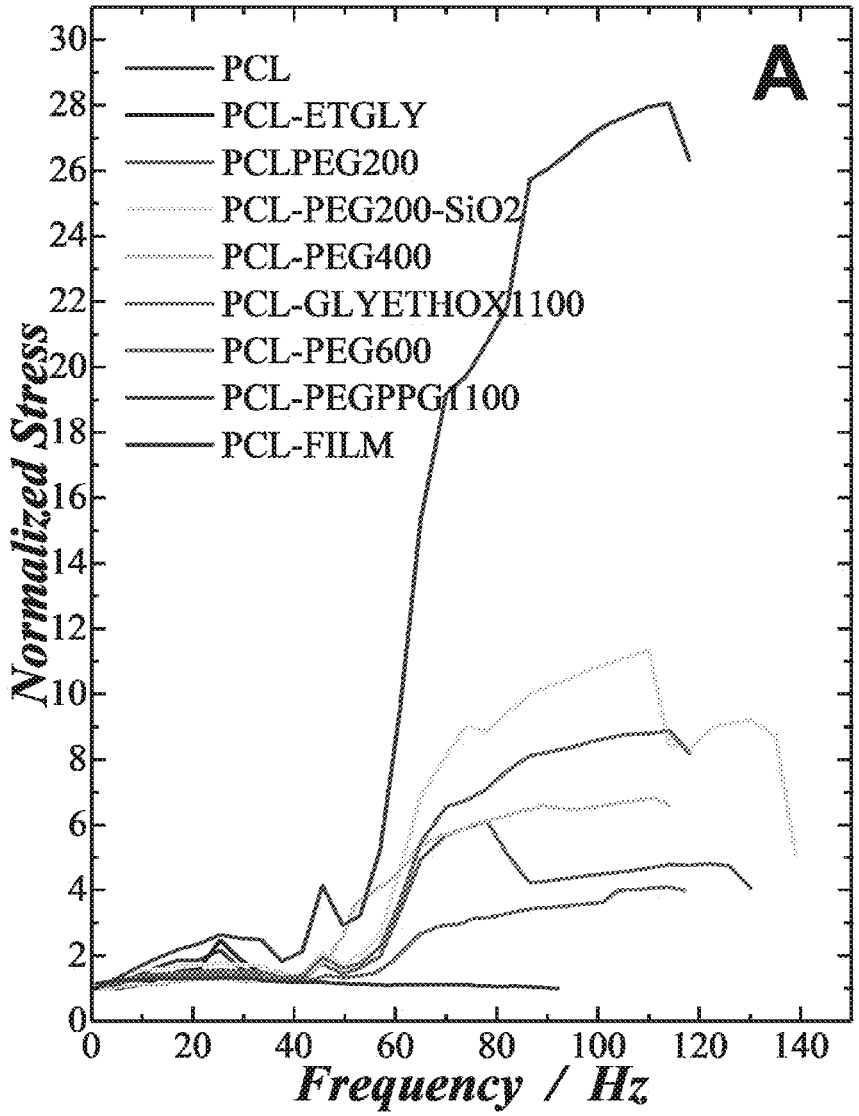
FIG. 4A shows normalized DMA stress curves as a function of mechanical oscillation in the tensile mode at 1% stain.
Figure 9:
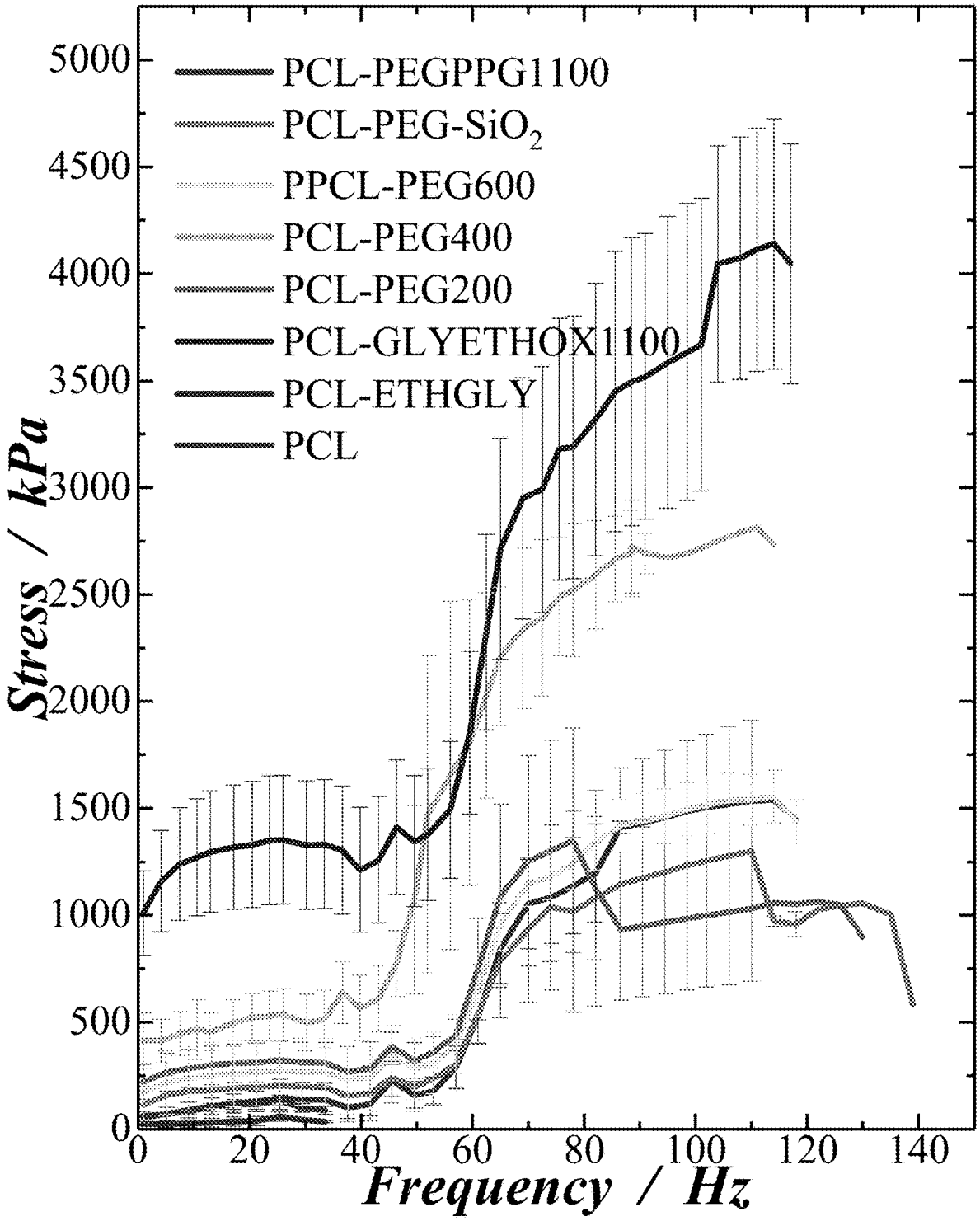
FIG. 9 shows stress curves of the electrospun fiber mats and a PCL film as a function of mechanical oscillation in the tensile mode at 1% stain. The curves represent the average of three measurements and the error bars denote the standard deviation.
Figure 10:
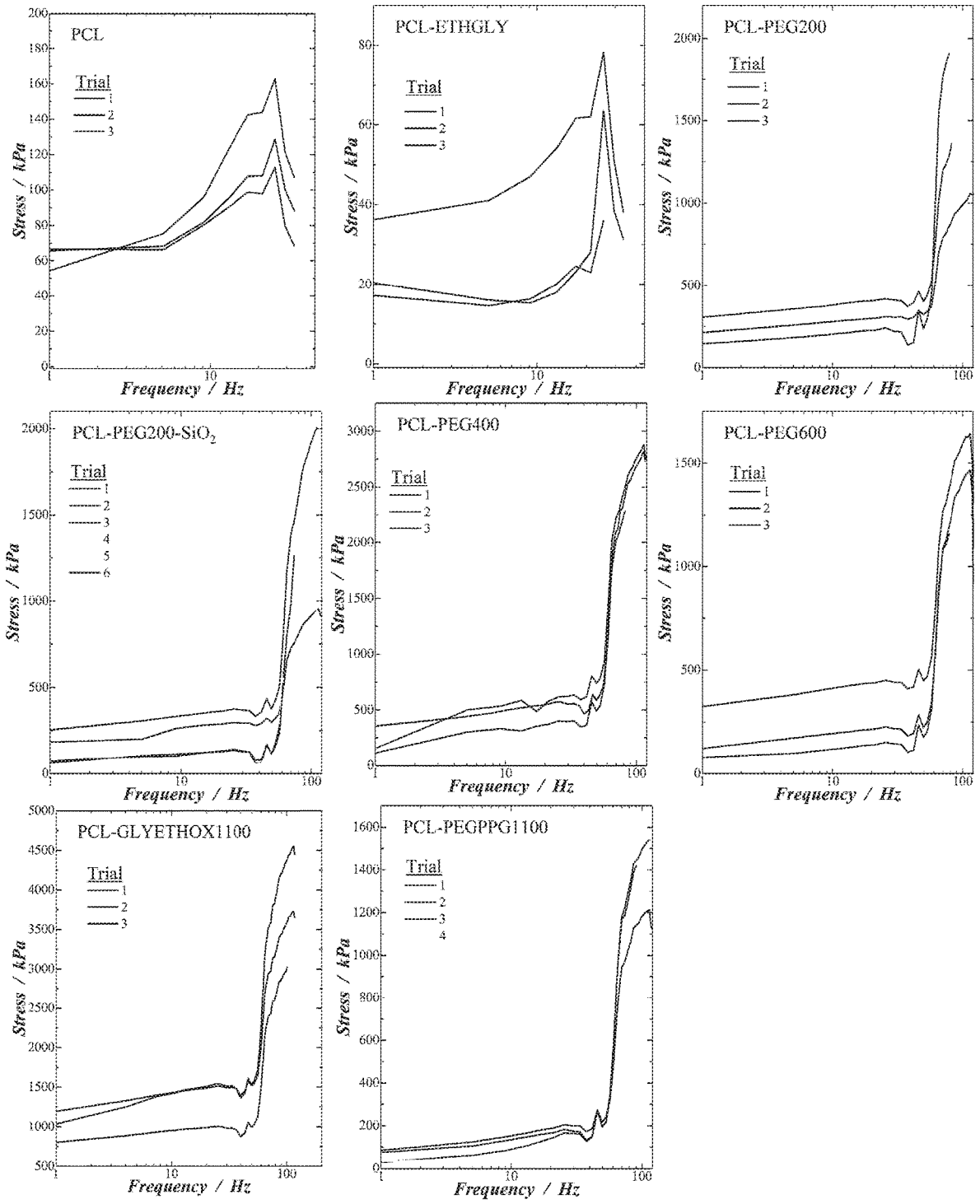
FIG. 10 shows individual stress curves of electrospun fiber mats as a function of mechanical oscillation in the tensile mode at 1% stain.

The stiffening behavior of the core-sheath fibers was assessed by mechanical oscillation of non-woven fiber mats over the range of 0-140 Hz at 1% tensile strain. In FIG. 4A, the normalized mechanical frequency sweep curves from the averages of three measurements per sample are shown. The individual oscillation experiments and the non-normalized mechanical frequency sweep curves including their standard deviations and are shown in FIGS. 9-10.

Figure 11:
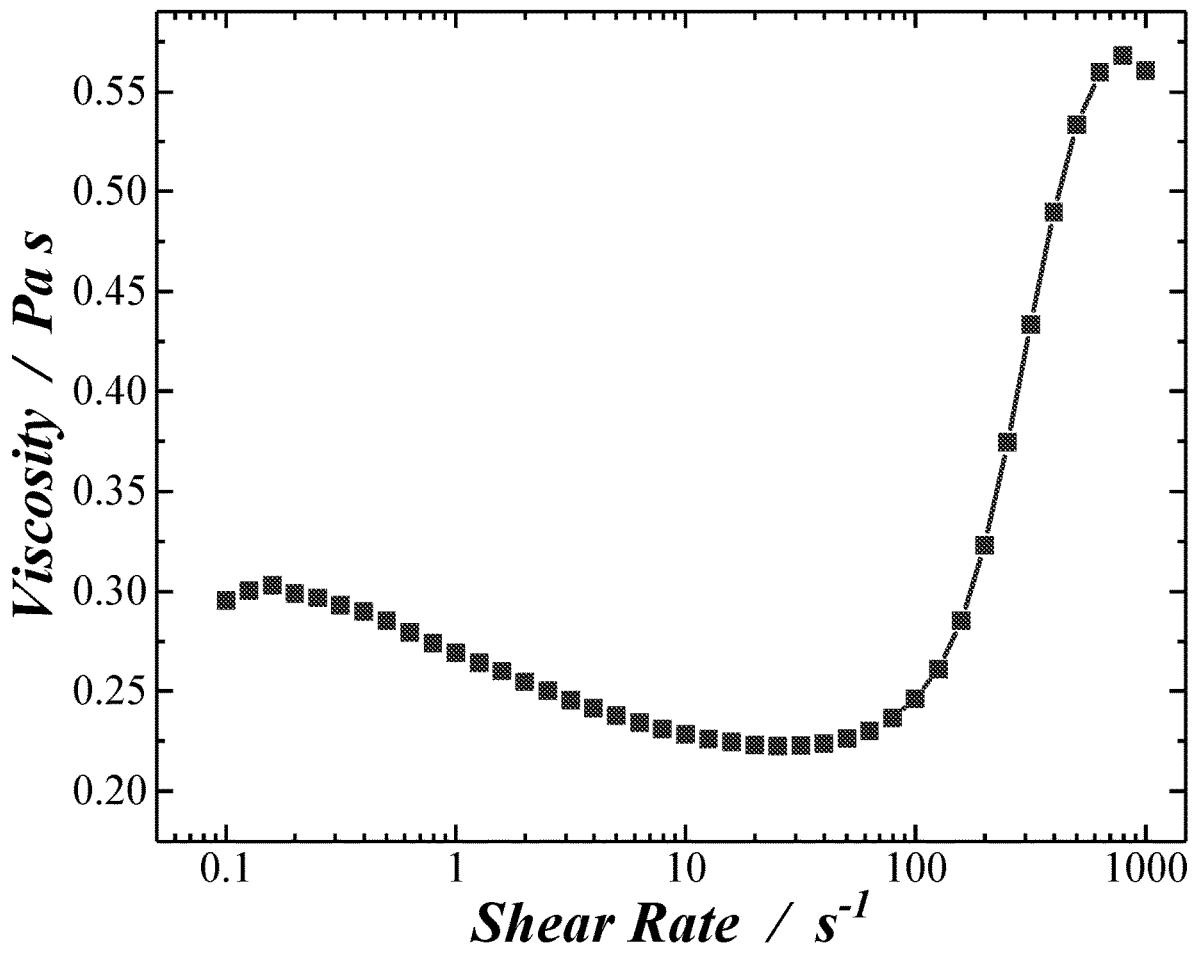
FIG. 11 shows steady-shear rheological experiments showing the dynamic viscosity of the shear-thickening fluid (9 wt % fumed silica in PEG200) as a function of steady-shear rate at 1% strain.

A tensile frequency sweep of the PCL fibers with the shear-thickening fluid (PEG200-$SiO_2$) in the cores led to the appearance of characteristic dilatant behavior at a critical onset point of 60 Hz. In fact, the critical onset point at 60 Hz is similar to the bulk PEG200-$SiO_2$ fluid (ca. 57 Hz) as determined via steady-state rheological shear experiments (FIG. 11). Comparisons can also be made by taking the ratio of the average values of the stress plateaus both before and after the critical onset point; this ratio is indicative of the stress increase from their original values. Thus, the stress increase of PCL-PEG200-$SiO_2$ is nearly ca. 5× its initial value and the same comparison for neat PEG200-$SiO_2$ shows that its stress increases by only ca. 2.4×. Clearly, the stress increase of the PCL-PEG200-$SiO_2$ fibers is double that of the neat PEG200-$SiO_2$ and such a difference can only be explained by interactions between the core fluid and the PCL sheath walls.

Figure 12:
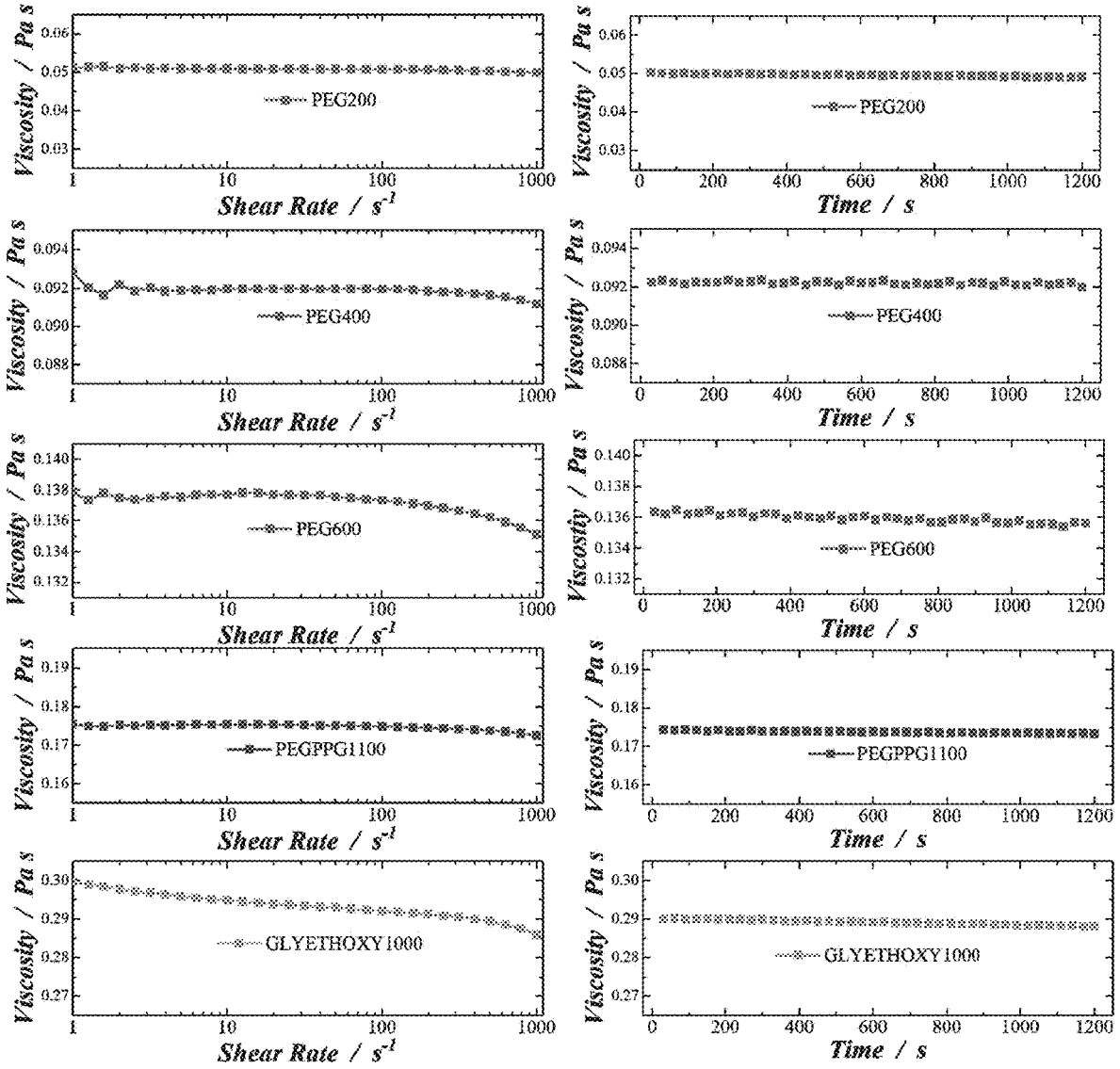
FIG. 12 shows steady-shear rheological experiments showing the dynamic viscosity of the various core fluids as a function of shear rate (left) and shear time (right; shear rate=100 $s^{-1}$) at 1% stain.

Surprisingly, the core-sheath fibers still exhibited the stiffening behavior without the $SiO_2$ particles (FIG. 4A), albeit the stiffening behavior was reduced. The stress increase of the PCL-PEG200 fibers was reduced by half when compared to its counterpart with the $SiO_2$ particles (PCL-PEG200-$SiO_2$). Thus, the decrease suggests that approximately half of the stiffening behavior of the PCL-PEG200-$SiO_2$ fibers can be attributed directly to interactions between the PCL sheath and PEG200 core; this observation is also supported by the twofold stress increase of PEG200-$SiO_2$ when confined in the fibers. The changes in the stress increase indicate that a unique interaction occurs between the PCL and encapsulated PEG200 because neat PEG200 behaves as a typical Newtonian fluid (FIG. 12). Note that PCL and PEG used here are virtually immiscible because a homogenous solution of the two was unable to be formed by heating mixtures of either 10 wt % PCL in PEG200 or 10 wt % PEG200 in PCL to 150° C. The strong immiscibility of PCL and PEG200 may provide repulsive interactions consequential to the stiffening behavior observed here.

Figure 4B:
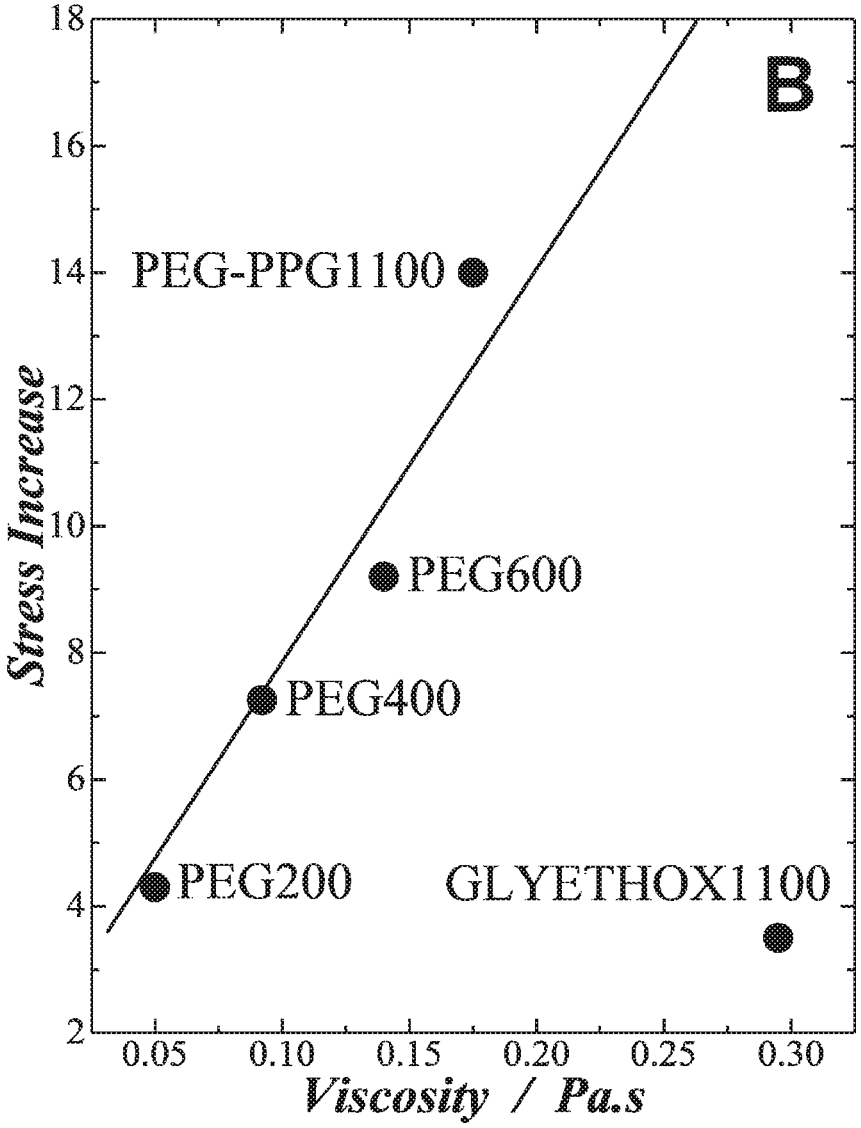
FIG. 4B show a plot of the stress increase of the core-sheath fibers after the critical onset point versus core liquid viscosity.
Figure 13:
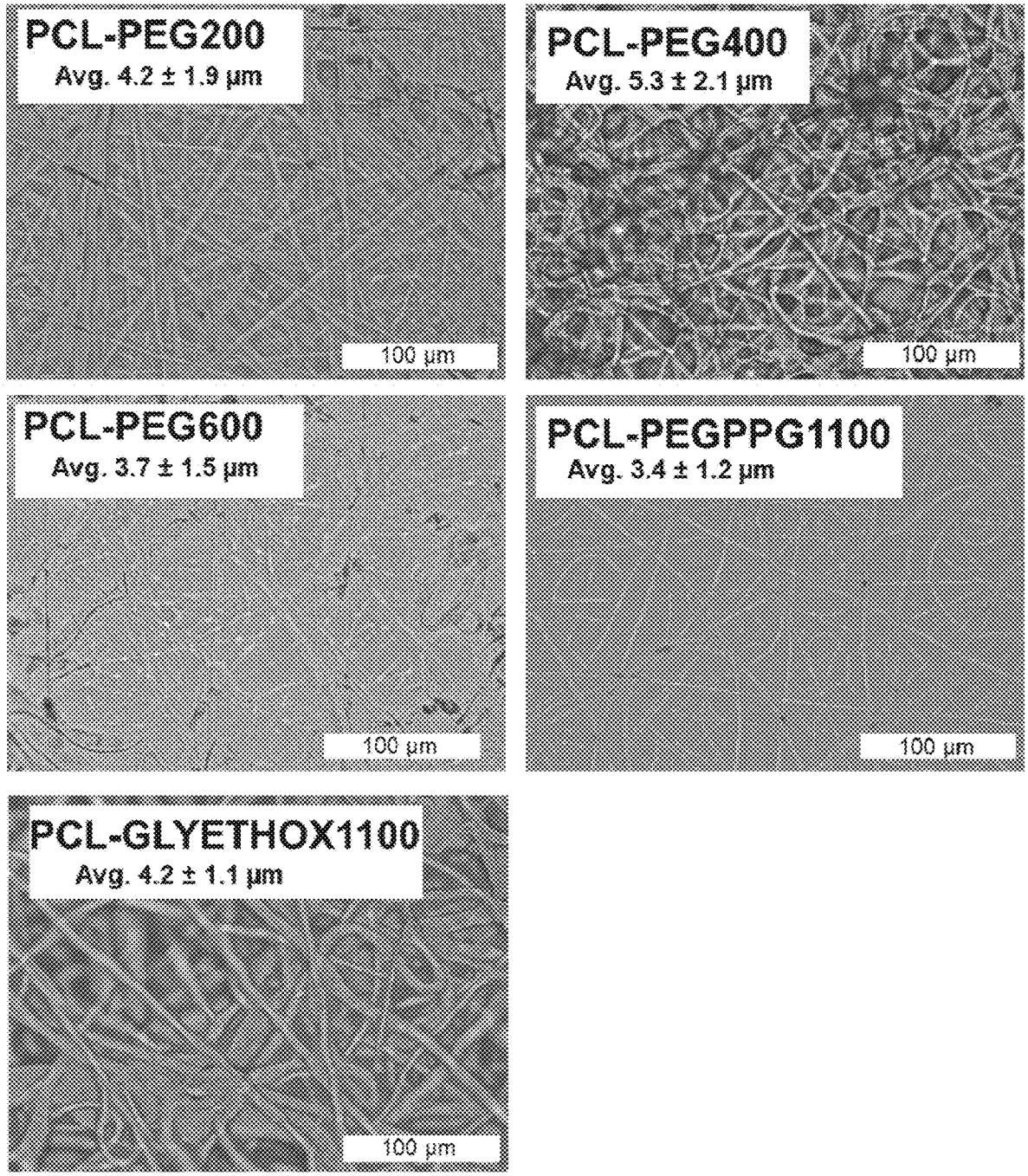
FIG. 13 shows representative optical microscopy images of core-sheath fibers with composition and average fiber diameter (±1 standard deviation) shown in insets. Scale bars are 100 μm.

The core-sheath PCL fibers with different core fluids were evaluated to understand the influence of viscosity (FIG. 4A). In general, as the viscosities of the core liquids were increased, the frequency dependent stiffness of the fibers increased. Note that the stiffening effect was not observed in the single-phase PCL fibers, a film of PCL, and core-sheath fibers in which ethylene glycol was the core liquid. Furthermore, the core-sheath fibers exhibited similar morphology and fibers diameters between each formulation (FIG. 13). In FIG. 4B, a plot of the core fluid viscosities as a function of the stress increases clearly demonstrates a linear correlation with the exception of GLYETHOX1100. Because the fibers with GLYETHOX1100 exhibited a stress response that did not correlate with the other PEGs, it is surmised that it has additional steric considerations which influence its stress behavior. The multiple arms of GLYETHOX1100 decrease its contour length when compared to a linear PEG with identical $M_w$ (PEG-PPG1100). Further, these structural considerations may also lead to poor shear alignment because the linear PEGs are able to move more quickly than GLYETHOX1000 in response to shear stress; this type of alignment leads to long-range polymer interactions from the numerous overlapping polymer chains. Thus, GLYETHOX1100 should have more limited long-range interactions with other nearby molecules. Although the viscosity of the core liquids is important, the deviation of GLYETHOX1100 from the trend displayed for the linear PEGs suggests that long-range polymer chain entanglements are similarly important. Thus, the correlation between stress increase and viscosity among the other core liquids indicates that the stiffening behavior of the core-sheath fibers is dependent acutely on these factors.

Figure 4C:
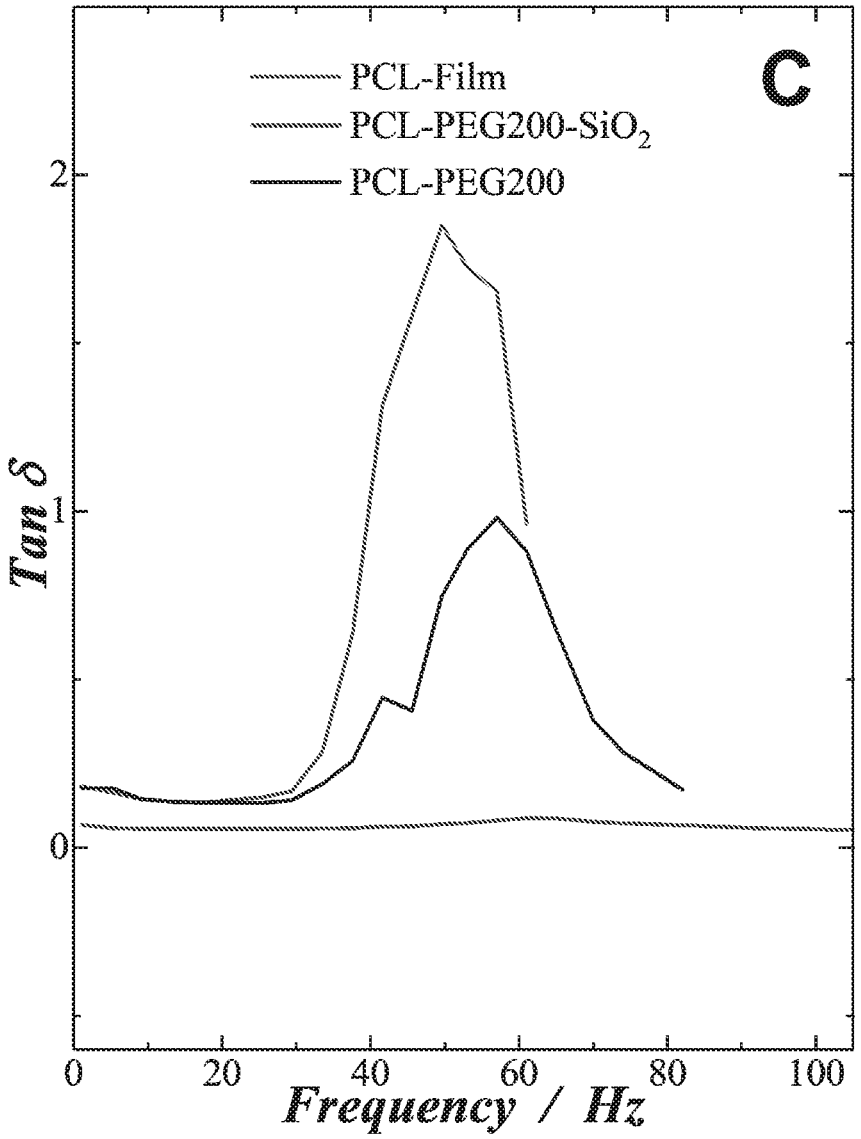
FIG. 4C shows tan δ values of the core-sheath fibers and a neat PCL film as a function of oscillation frequency. The sheath and core flow rates were 3 and 1 ml $hr^{-1}$, respectively.

Interestingly, the tan δ values (the ability of a material to dissipate energy, FIG. 4C) of the core-sheath fibers with PEG200 (in the presence and absence of $SiO_2$ particles) and a neat PCL film indicates that the core-sheath fibers can dissipate energy to a much greater degree. This difference makes clear that viscous liquids in the cores of the fibers are necessary for energy dissipation. Further, PCL-PEG200-$SiO_2$ fibers had larger tan δ values than the PCL-PEG200 fibers because the $SiO_2$ particles are able to dissipate energy via their shear-thickening behavior on the liquid portion.

Figure 5:
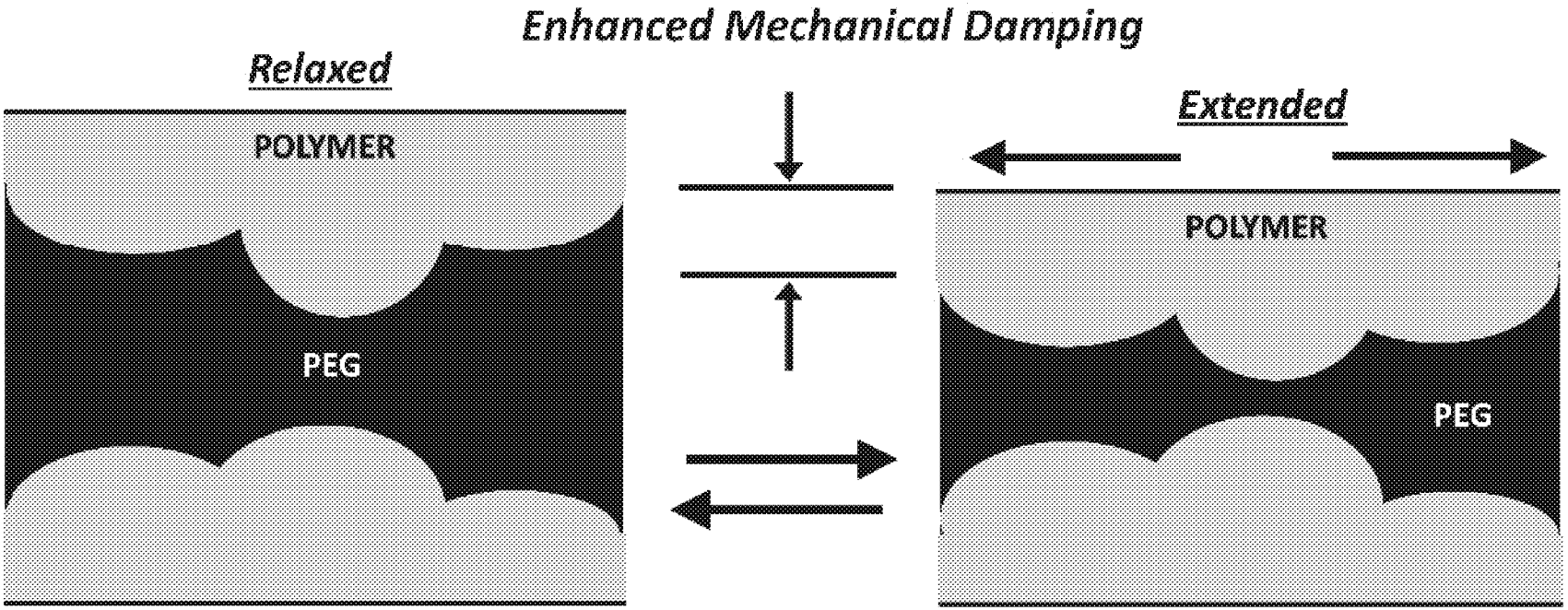
FIG. 5 shows a conceptual representation of a cross-section of the fluid filled fiber structures when subjected to mechanical oscillatory extension. The arrows indicate the direction of tension induced on the fibers during oscillation and its reversibility.

Model of Enhanced Mechanical Damping—The enhanced mechanical damping was observed in the core-sheath fibers containing the shear-thickening fluid (PEG200-$SiO_2$) and those which contained the Newtonian PEG liquids. In FIG. 5, a working model is proposed to describe how the damping behavior may occur in the absence of the $SiO_2$ particles. Thus, it is well-known that the electrospinning process requires solution instability (Rayleigh instability) for the formation of fibers. The Rayleigh instability causes the polymer solution jet to stretch and adopt a non-uniform, wave-like appearance along the stream (or length of the fiber); the same instability also applies to the core fluids. Such Rayleigh instability in the core fluid can also be caused by the difference in surface tension between the core fluid and the polymer solution. Thus, the interior core channels of electrospun core-sheath fibers have a wave-like structure that varies in shape and size along the long axis of the fiber.[15]

Mechanical oscillatory extension of the fibers causes dramatic changes to the sheath with respect to its core shape and volume. According to the Poisson effect, extension of the fiber mat increases the lengths of the fibers in the direction of the pull but causes a contraction in the transverse direction, effectively reducing the cross-sectional (i.e., diameter) core volume. Thus, oscillation of the fibers causes multiple changes to the fiber sheath and, in turn, the interior core channels.[60] The movement of the fluids along the core channels creates friction between the fluid and the sheath interface.[60-63] Further, other considerations of friction arise from the wave-like core channel structure because the channels create both narrow and wide passageways in which the liquids must fill. Thus, it is proposed that the stiffening effect results from the inability of the PEGs to diffuse throughout the core channels on the same timescale of the oscillation; this situation creates flow instabilities which increase the frictional forces that lead to dynamic jamming.[48] As such, a longer molecule with a higher viscosity and more long-range chain entanglements will have greater difficulty diffusing throughout the core channels. Thus, the difficulty of longer chain PEGs to diffuse throughout the core channels can be explained by the correlation between the relative stress increase of core-sheath fibers and their core liquid viscosities (FIG. 4B); this is also suggested by the low stress response of fibers filled with GLYETHOX1100 because its high viscosity but short contour length does not follow the trend of the longer PEGs. Thus, the mechanical damping behavior of the fibers is tunable because it results from a combination of factors that are primarily associated with the viscosity and molecular relaxation dynamics of the core liquid.

Figure 6A:
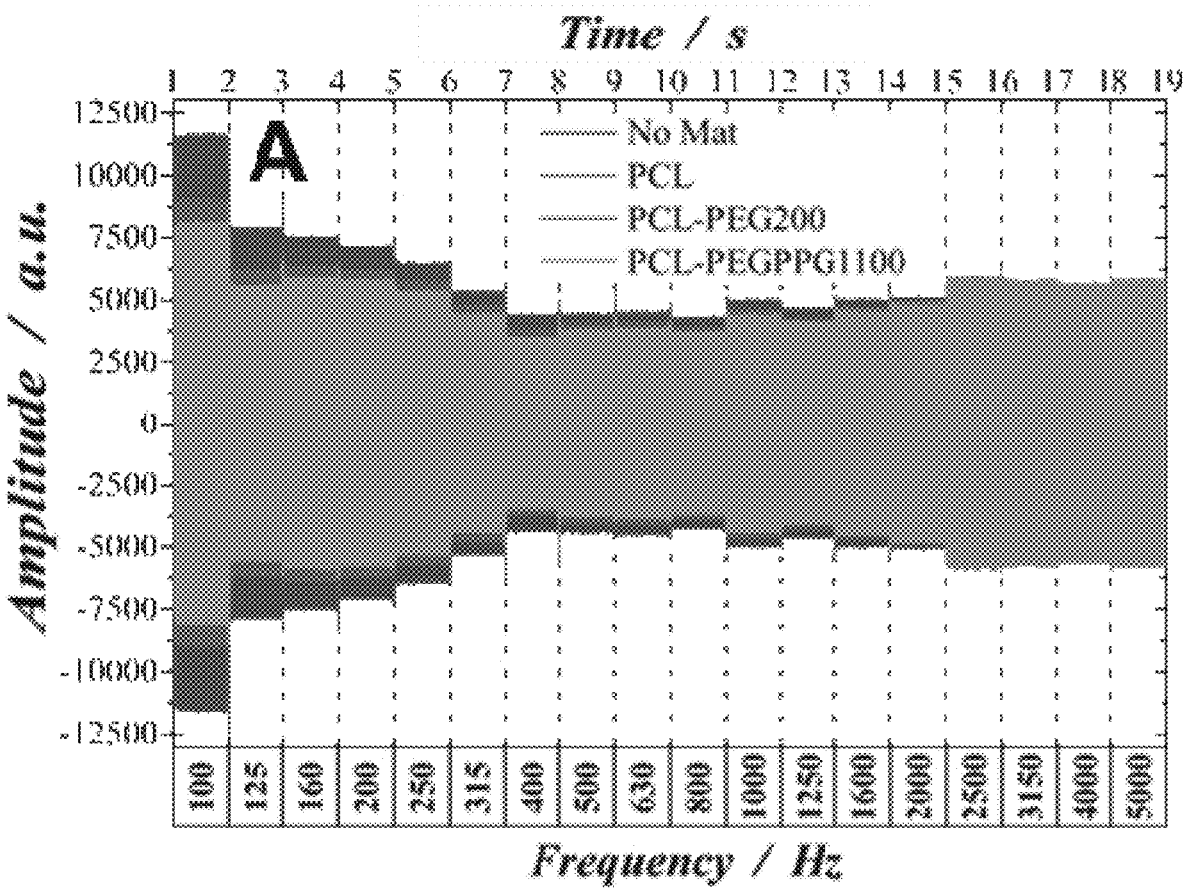
FIGS. 6A-G show a comparison of sound attenuation performance of fiber mats evaluated by (FIG. 6A) overlay of signals in ⅓ octave band test tones with percent reduction (FIG. 6B), (FIG. 6C) white and pink noise overlay with percent reduction (FIG. 6D), and (FIG. 6E) logarithmic frequency sweep overlay. The electrospun mat (FIG. 6F) was secured to a foam sleeve using T-pins 2.5 cm in front of the microphone capsule (FIG. 6G).
Figure 6B:
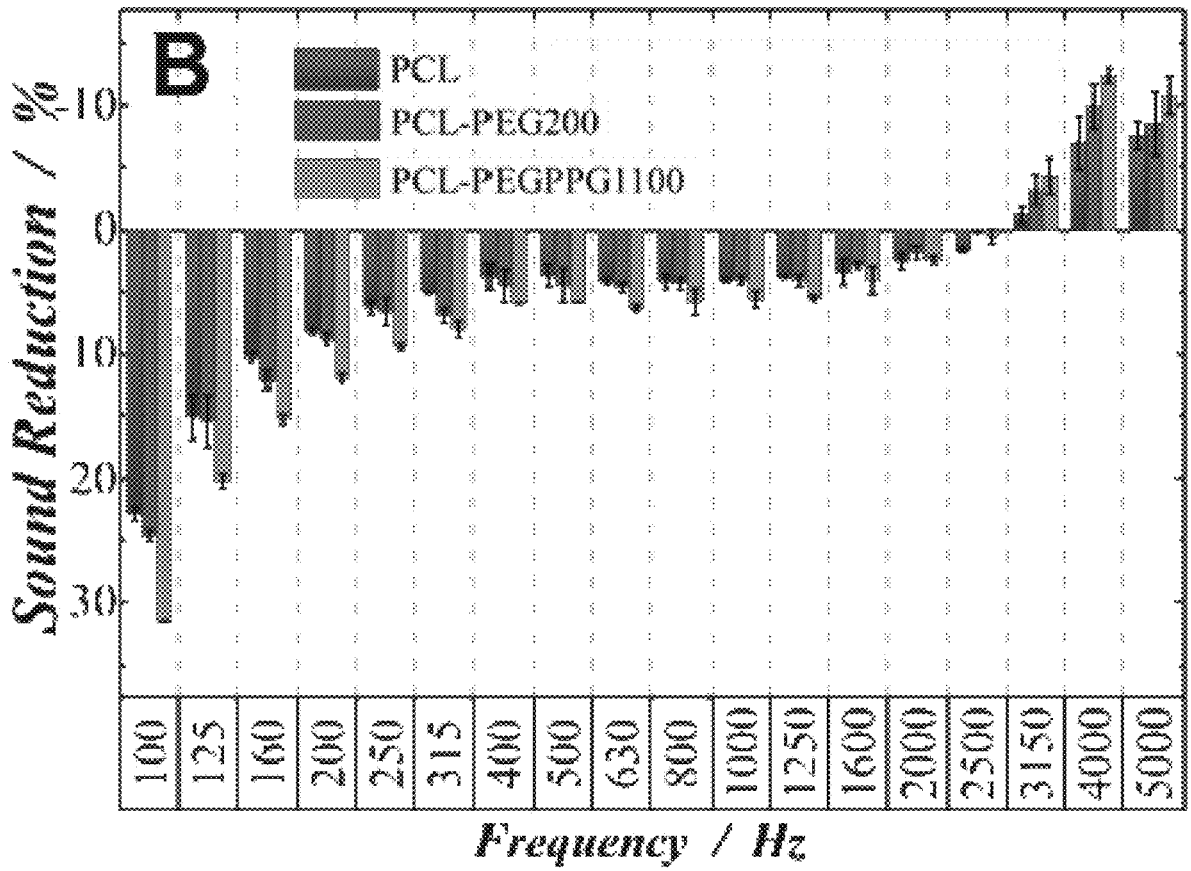
Figure 6C:
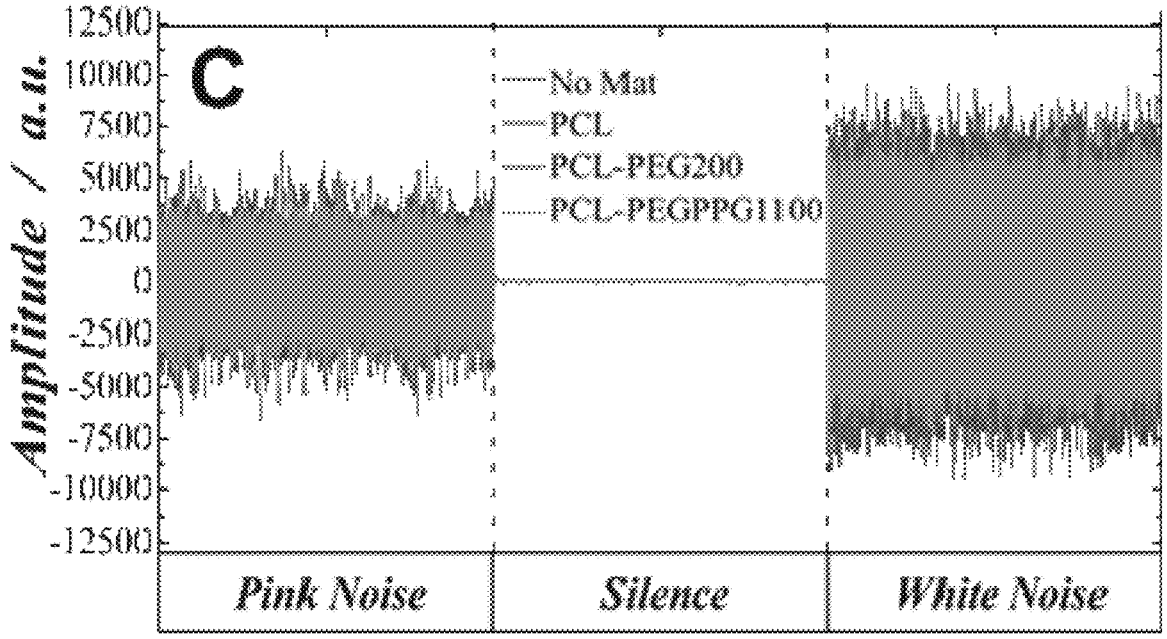
Figure 6D:
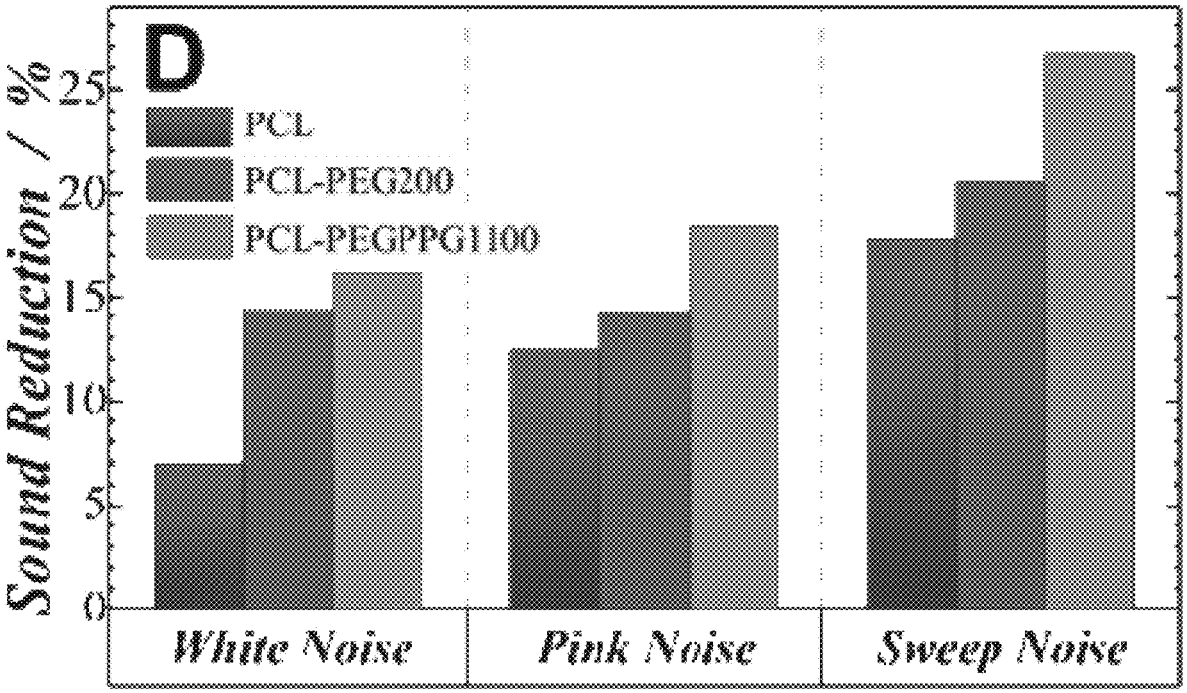
Figure 6E:
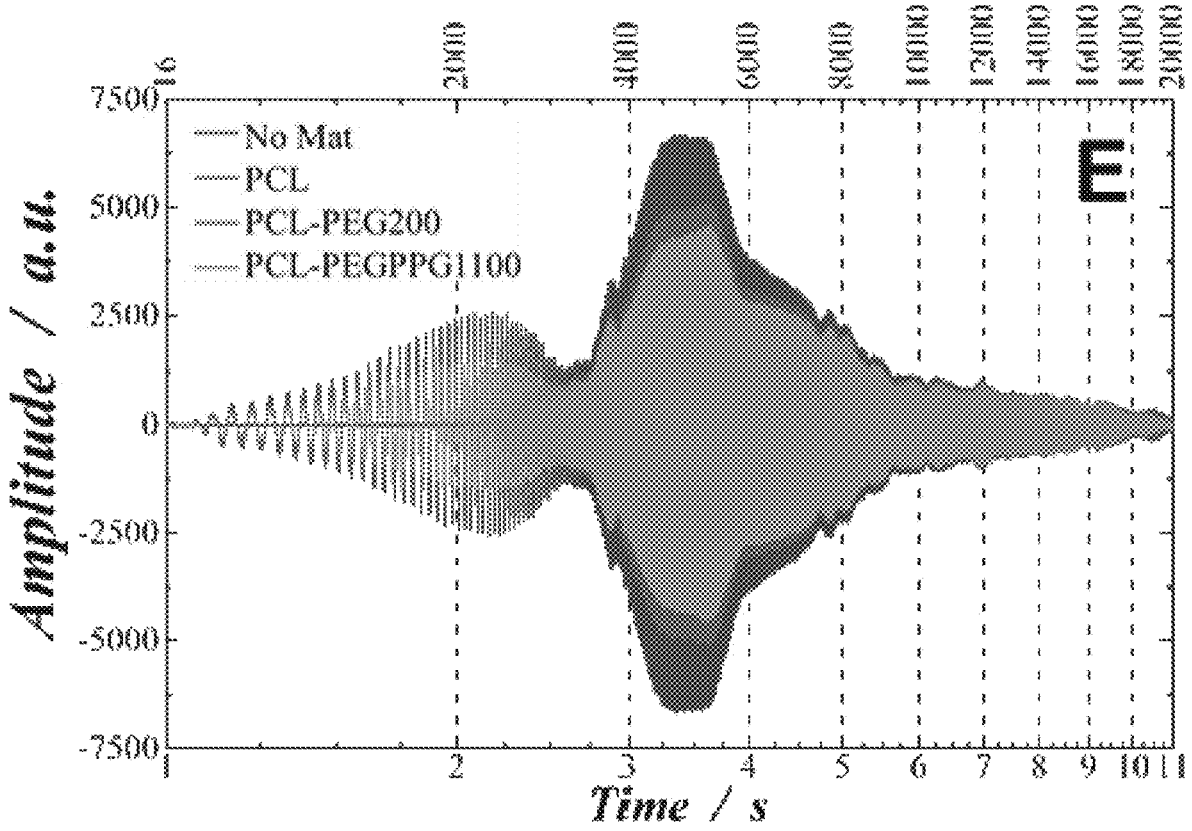
Figure 6F:
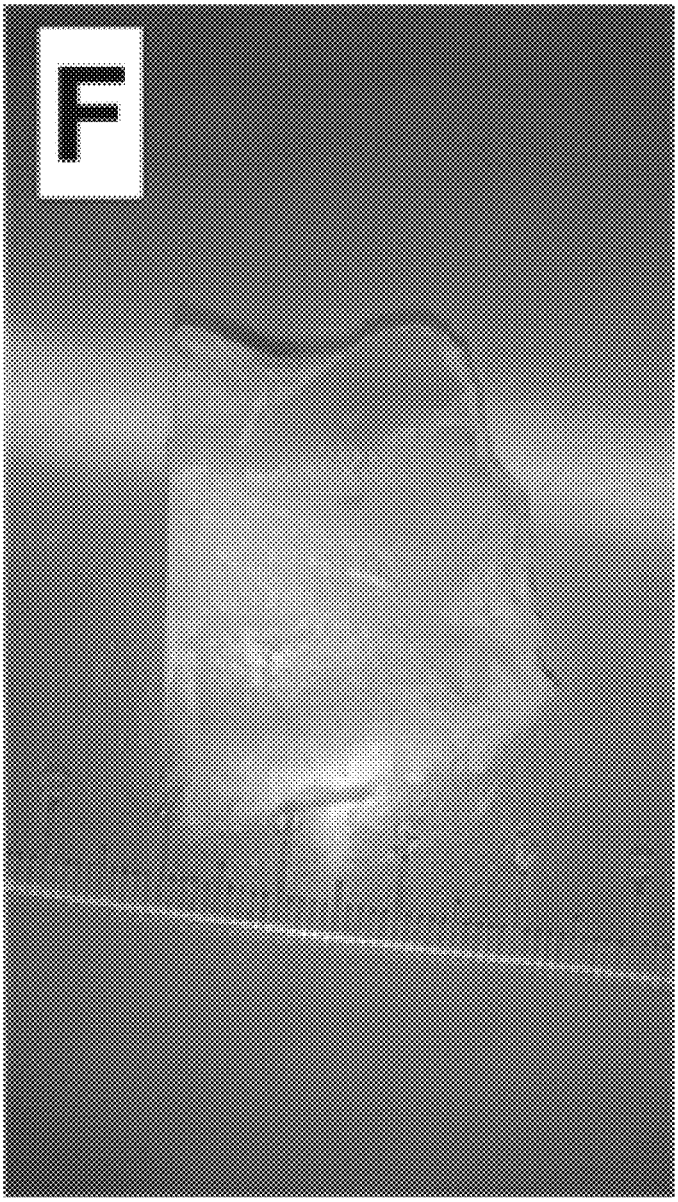
Figure 6G:
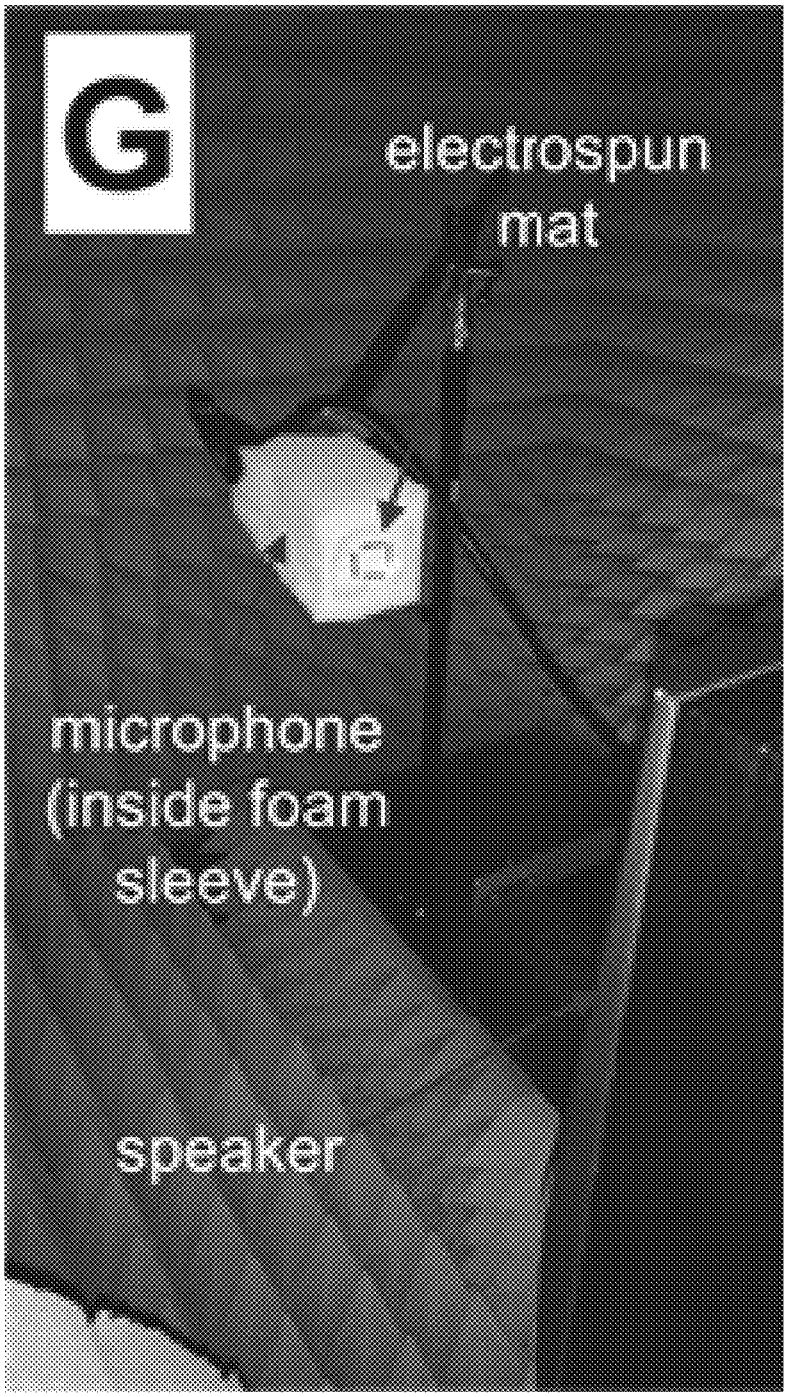

Fiber Sound Damping—The sound attenuating properties of materials is highly dependent on their mechanical behavior. Thus, the abilities of the non-woven fiber mats to reduce particle motion and attenuate sound were tested using the methods described in the experimental section and are shown in (FIGS. 6A-E). A typical experimental setup and a representative fiber mat are shown in FIGS. 6F-G. The audio files used for the sound damping experiments are described below. The samples used for the sound attenuation experiments were down-selected to the single-phase PCL fibers, and the core-sheath PCL-PEG200, and PCL-PEGPPG1100 fibers because they represent the widest range in core fluid viscosity. The damping abilities of the fiber mats as a function of frequency were tested by consecutive 1 sec tones from 100-5000 Hz, increasing in ⅓ band octaves (FIG. 6A). A reduction in the amplitude is indicative of sound attenuation. At each frequency step, the sound attenuation was greatest with the core-sheath fibers. The most viscous core, PCL-PEGPPG1100, showed the greatest amount of attenuation. These data suggest increased capacity of sound pressure dispersion with more viscous fiber cores. The core-sheath fibers exhibited especially strong sound attenuation at lower frequencies (100-315 Hz), however, this effect diminishes somewhat with increasing frequency (FIG. 6B). Note that at frequencies greater than ca. 3000 Hz, an increase in the amplitude was observed compared to the control experiment in which the sound was not impeded (i.e., no fiber mat). This behavior is attributed to reflection of the higher frequencies back towards the microphone from the fiber mats.

Other attenuation tests were performed using by using either equal power (pink noise) or amplitude (white noise) per octave band (FIGS. 6C-D) and by a logarithmic audio sweep (FIG. 6E) to deconvolute any mixed frequency behavior. Similar to the frequency test tone result, the core-sheath fiber mats showed greater sound attenuation than the single-phase PCL fibers (measured by comparing integrated absolute total amplitude) (FIGS. 6C-E). Specifically, the PCL-PEGPPG1100 fibers reduced the overall integrated absolute amplitude by 26.6% compared to no mat; low frequency sound attenuation is also increased with increasing viscosity of the core fluid. Further, the single-phase PCL fibers and the PCL-PEG200 fibers reduced total sound by 17.8 and 20.5%, respectively (FIG. 6D). Similar sound attenuation trends were observed for white and pink noise experiments as well (FIG. 6D).

Importantly, the low frequency sound attenuation by the PCL-PEG200 and PCL-PEGPPG1100 fibers occurred in the same frequency region in which stiffening of the fibers was observed via extensional mechanical oscillation. Thus, it is clear that the core channels filled with PEG is important for sound attenuation and that a longer PEG chain length provides greater attenuation than a shorter one likely due to viscosity differences. Typically, mechanisms of sound attenuation are attributed to scattering, redirection, and/or oscillation of fluid particles converting sound into heat as a function of its viscosity.[56] It is supposed that each of these mechanisms can occur in the fibers and to varying degrees, but their significance is dictated by the viscosity of the core fluid. Thus, it is suspected that the sound attenuation capabilities, and the frequency range over which optimal performance occurs, may be tuned by modulating the core fluid.

The encapsulation of a shear-thickening fluid in the cores of core-sheath fibers was achieved via coaxial electrospinning and its application to sound damping has been explored. Notably, a preferential reduction of low-frequency auditory sound (~100-400 Hz) was observed. Surprisingly, it was found that shear-thickening fluids are not a prerequisite for sound attention in liquid core-polymer sheath fibers. Thus, other viscous Newtonian liquids have been also employed as the core material. The effects of the confinement of liquids in a core-sheath structure have been made using optical microscopy, rheology, and dynamic mechanical analysis. Mechanical extensional oscillation of the fibers caused a stiffening effect as the frequency was increased. Notably, the stiffening behavior of the shear-thickening fluid was found to increase nearly twofold when confined in the cores of the fibers; its enhancement is explained on the basis of boundary interactions with the fiber sheath and the difficulties associated with diffusion of the liquid through the core channels. Thus, the introduction of core liquids with different viscosities had a profound effect on the stiffening behavior of the fibers. The stiffening effect was found to correlate acutely with the viscosities of the encapsulated liquids and it appears that long-range chain entanglements are also important. In sum, the results suggest that the stiffening occurs from the difficulties associated with the liquids diffusing through the core channels during oscillation leading to friction and stiffening of the fibers.

The fibers were also tested on their abilities to dampen a variety of auditory sounds (i.e., test tones, frequency sweep, white and pink noise). In all cases, the core-sheath fibers dampened sound to a greater extent than the single-phase fibers. The fibers that contained the most viscous (and longest chain) PEG provided the most damping than those with a less viscous PEG. An auditory frequency sweep of the fibers with the most viscous (and linear) PEG was able to reduce the total integrated absolute amplitude by 26.6%. Similarly, the more viscous core showed the greatest sound attenuation of white and pink noise. Individual test tone frequencies (steps among 100-5000 Hz) played through the fibers showed that the sound attenuation is greatest at the lower frequency ranges. The correlation between the low frequency sound attenuation and similar frequencies at which the fibers exhibit their viscosity dependent mechanical stiffening suggests that the frequency range over which the fibers attenuate sound may be tuned depending on the fluid core viscosity.

Obviously, many modifications and variations are possible in light of the above teachings. It is therefore to be understood that the claimed subject matter may be practiced otherwise than as specifically described. Any reference to claim elements in the singular, e.g., using the articles "a", "an", "the", or "said" is not construed as limiting the element to the singular.

REFERENCES

1. Bhaskar, S.; Lahann, J. Microstructured Materials Based on Multicompartmental Fibers. *J. Am. Chem. Soc.* 2009, 131, 6650-6651.
2. Cho, K.; Lee, H. J.; Han, S. W.; Min, J. H.; Park, H.; Koh, W.-G. Multi-Compartmental Hydrogel Microparticles Fabricated by Combination of Sequential Electrospinning and Photopatterning. *Angew. Chem., Int. Ed.* 2015, 54, 11511-11515.

3. Hou, X.; Hu, Y.; Grinthal, A.; Khan, M.; Aizenberg, J. Liquid-Based Gating Mechanism with Tunable Multiphase Selectivity and Antifouling Behaviour. *Nature* 2015, 519, 70.
4. Park, K.-C.; Kim, P.; Grinthal, A.; He, N.; Fox, D.; Weaver, J. C.; Aizenberg, J. Condensation on Slippery Asymmetric Bumps. *Nature* 2016, 531, 78.
5. Zheng, Y.; Bai, H.; Huang, Z.; Tian, X.; Nie, F.-Q.; Zhao, Y.; Zhai, J.; Jiang, L. Directional Water Collection on Wetted Spider Silk. *Nature* 2010, 463, 640.
6. Zhou, G.; Yang, G.; Li, X.; Chen, B.; Fan, J.; Hou, X.; Zhou, S. Flexible Polymer Ultra-Fine Fiber with Extreme Toughness. *ACS Appl. Mater. Interfaces* 2018, 10, 14276-14280.
7. Bertocchi, M. J.; Ratchford, D. C.; Casalini, R.; Wynne, J. H.; Lundin, J. G. Electrospun Polymer Fibers Containing a Liquid Crystal Core: Insights into Semiflexible Confinement. *J. Phys. Chem. C* 2018, 122, 16964-16973.
8. Enz, E.; Lagerwall, J. Electrospun Microfibres with Temperature Sensitive Iridescence From Encapsulated Cholesteric Liquid Crystal. *J. Mater. Chem.* 2010, 20, 6866-6872.
9. Wang, Z.; Yuan, X.; Cong, S.; Chen, Z.; Li, Q.; Geng, F.; Zhao, Z. Color-Changing Microfiber-Based Multifunctional Window Screen for Capture and Visualized Monitoring of NH3. *ACS Appl. Mater. Interfaces* 2018, 10, 15065-15072.
10. Jiang, S.; Duan, G.; Zussman, E.; Greiner, A.; Agarwal, S. Highly Flexible and Tough Concentric Triaxial Polystyrene Fibers. *ACS Appl. Mater. Interfaces* 2014, 6, 5918-5923.
11. Wang, C.; Hsiue, T.-T. Core-Shell Fibers Electrospun from Phase-Separated Blend Solutions: Fiber Formation Mechanism and Unique Energy Dissipation for Synergistic Fiber Toughness. *Biomacromolecules* 2017, 18, 2906-2917.
12. Li, D.; Xia, Y. Direct Fabrication of Composite and Ceramic Hollow Nanofibers by Electrospinning. *Nano Lett.* 2004, 4, 933-938.
13. McCann, J. T.; Li, D.; Xia, Y. Electrospinning of Nanofibers with core-sheath, hollow, or porous structures. *J. Mater. Chem.* 2005, 15, 735-738.
14. Glotzer, S. C.; Solomon, M. J. Anisotropy of Building Blocks and Their Assembly into Complex Structures. *Nat. Mater.* 2007, 6, 557.
15. Kim, D. K.; Lagerwall, J. P. F. Influence of Wetting on Morphology and Core Content in Electrospun Core-Sheath Fibers. *ACS Appl. Mater. Interfaces* 2014, 6, 16441-16447.
16. Min, S. Y.; Kim, T. S.; Kim, B. J.; Cho, H.; Noh, Y. Y.; Yang, H.; Cho, J. H.; Lee, T. W. Large-Scale Organic Nanowire Lithography and Electronics. *Nat. Commun.* 2013, 4, 1773.
17. Kim, D. K.; Hwang, M.; Lagerwall, J. P. F. Liquid Crystal-Functionalization of Electrospun Polymer Fibers. *J. Polym. Sci., Part B: Polym. Phys.* 2013, 51, 855.
18. Medina-Castillo, A. L.; Fernández-Sánchez, J. F.; Fernández-Gutiérez, A. One-Step Fabrication of Multifunctional Core-Shell Fibres by Co-Electrospinning. *Adv. Funct. Mater.* 2011, 21, 3488.
19. Yang, H.; Lightner, C. R.; Dong, L. Light-Emitting Coaxial Nanofibers. *ACS Nano* 2012, 6, 622.
20. Lee, K. J.; Yoon, J.; Rahmani, S.; Hwang, S.; Bhaskar, S.; Mitragotri, S.; Lahann, J. Spontaneous Shape Reconfigurations in Multicompartmental Microcylinders. *Proc. Natl. Acad. Sci. U.S.A.* 2012, 109, 16057.
21. Park, M.; Im, J.; Shin, M.; Min, Y.; Park, J.; Cho, H.; Park, S.; Shim, M. B.; Jeon, S.; Chung, D. Y.; Bae, J.; Park, J.; Jeong, U.; Kim, K. Highly Stretchable Electric Circuits from a Composite Material of Silver Nanoparticles and Elastomeric Fibres. *Nat. Nanotechnol.* 2012, 7, 803.
22. Park, J. H.; Braun, P. V. Coaxial Electrospinning of Self-Healing Coatings. *Adv. Mater.* 2009, 22, 496.
23. Zussman, E. Encapsulation of Cells within Electrospun Fibers. *Polym. Adv. Technol.* 2011, 22, 366.
24. Hufenus, R.; Gottardo, L.; Leal, A. A.; Zemp, A.; Heutschi, K.; Schuetz, P.; Meyer, V. R.; Heuberger, M. Melt-Spun Polymer Fibers with Liquid Core Exhibit Enhanced Mechanical Damping. *Mater. Des.* 2016, 110, 685-692.
25. Abouraddy, A. F.; Bayindir, M.; Benoit, G.; Hart, S. D.; Kuriki, K.; Orf, N.; Shapira, O.; Sorin, F.; Temelkuran, B.; Fink, Y. Towards Multimaterial Multifunctional Fibres that See, Hear, Sense and Communicate. *Nat. Mater.* 2007, 6, 336.
26. Stolyarov, A. M.; Wei, L.; Shapira, O.; Sorin, F.; Chua, S. L.; Joannopoulos, J. D.; Fink, Y. Microfluidic Directional Emission Control of an Azimuthally Polarized Radial Fibre Laser. *Nat. Photonics* 2012, 6, 229.
27. Stolyarov, A. M. W., L.; Sorin, F.; Lestoquoy, G.; Joannopoulos, J. D.; Fink, Y. Fabrication and Characterization of Fibers with Built-In Liquid Crystal Channels and Electrodes for Transverse Incident-Light Modulation. *Appl. Phys. Lett.* 2012, 101, 011108.
28. Cho, H.; Min, S. Y.; Lee, T. W. Electrospun Organic Nanofiber Electronics and Photonics. *Macromol. Mater. Eng.* 2013, 298, 475.
29. Choi, S. H.; Youn, D. Y.; Jo, S. M.; Oh, S. G.; Kim, I. D. Micelle-Mediated Synthesis of Single-Crystalline β(3C)-SiC Fibers via Emulsion Electrospinning. *ACS Appl. Mater. Interfaces.* 2011, 3, 1385.
30. Lee, J. S.; Kwon, O. S.; Park, S. J.; Park, E. Y.; You, S. A.; Yoon, H.; Jang, J. Fabrication of Ultrafine Metal-Oxide-Decorated Carbon Nanofibers for DMMP Sensor Application. *ACS Nano* 2011, 5, 7992.
31. Krogman, K. C.; Lowery, J. L.; Zacharia, N. S.; Rutledge, G. C.; Hammond, P. T. Spraying Asymmetry into Functional Membranes Layer-by-Layer. *Nat. Mater.* 2009, 8, 512.
32. Camposeo, A.; Di Benedetto, F.; Stabile, R.; Neves, A. A. R.; Cingolani, R.; Pisignano, D. Laser Emission from Electrospun Polymer Nanofibers. *Small* 2009, 5, 562.
33. Wang, N.; Chen, H. Y.; Lin, L.; Zhao, Y.; Cao, X. Y.; Song, Y. L.; Jiang, L. Multicomponent Phase Change Microfibers Prepared by Temperature Control Multifluidic Electrospinning. *Macromol. Rapid Commun.* 2010, 31, 1622.
34. Deitzel, J. M.; Kleinmeyer, J. D.; Hirvonen, J. K.; Beck Tan, N. C. Controlled Deposition of Electrospun Poly(Ethylene Oxide) Fibers. *Polymer* 2001, 42, 8163-8170.
35. Huang, Z.-M.; Zhang, Y. Z.; Kotaki, M.; Ramakrishna, S. A Review on Polymer Nanofibers by Electrospinning and their Applications in Nanocomposites. *Compos. Sci. Technol.* 2003, 63, 2223-2253.

36. Meng, X.; Perry, S. L.; Schiffman, J. D. Complex Coacervation: Chemically Stable Fibers Electrospun from Aqueous Polyelectrolyte Solutions. *ACS Macro Lett.* 2017, 6, 505-511.
37. Ramakrishna, S.; Fujihara, K.; Teo, W.-E.; Yong, T.; Ma, Z.; Ramaseshan, R. Electrospun Nanofibers: Solving Global Issues. *Mater. Today* 2006, 9, 40-50.
38. Yarin, A. L. Coaxial Electrospinning and Emulsion Electrospinning of Core-Shell Fibers. *Polym. Adv. Technol.* 2011, 22, 310.
39. Li, D.; Xia, Y. N. Direct Fabrication of Composite and Ceramic Hollow Nanofibers By Electrospinning. *Nano Lett.* 2004, 4, 933.
40. Loscertales, I. G.; Barrero, A.; Marquez, M.; Spretz, R.; Velarde-Ortiz, R.; Larsen, G. Electrically Forced Coaxial Nanojets for One-Step Hollow Nanofiber Design. *J. Am. Chem. Soc.* 2004, 126, 5376.
41. Lagerwall, J. P. F.; McCann, J. T.; Formo, E.; Scalia, G.; Xia, Y. Coaxial Electrospinning of Microfibres With Liquid Crystal in the Core. *Chem. Commun.* 2008, 42, 5420.
42. Enz, E.; Baumeister, U.; Lagerwall, J. Coaxial Electrospinning of Liquid Crystal-Containing Poly(Vinylpyrrolidone) Microfibres. *Beilstein J. Org. Chem.* 2009, 5, 1-8.
43. Wang, J.; Jakli, A.; West, J. L. Morphology Tuning of Electrospun Liquid Crystal/Polymer Fibers. *Chemphyschem* 2016, 17, 3080-3085.
44. Sharma, N.; Jaffari, G. H.; Shah, S. I.; Pochan, D. J. Orientation-Dependent Magnetic Behavior in Aligned Nanoparticle Arrays Constructed by Coaxial Electrospinning. *Nanotechnology* 2010, 21, 85707.
45. Ding, Y.; Li, W.; Correia, A.; Yang, Y.; Zheng, K.; Liu, D.; Schubert, D. W.; Boccaccini, A. R.; Santos, H. A.; Roether, J. A. Electrospun Polyhydroxybutyrate/Poly (ε-caprolactone)/Sol-Gel-Derived Silica Hybrid Scaffolds with Drug Releasing Function for Bone Tissue Engineering Applications. *ACS Appl. Mater. Interfaces* 2018, 10, 14540-14548.
46. Han, D.; Steckl, A. J. Triaxial Electrospun Nanofiber Membranes for Controlled Dual Release of Functional Molecules. *ACS Appl. Mater. Interfaces* 2013, 5, 8241-8245.
47. Eric, B.; Heinrich, M. J. Shear Thickening in Concentrated Suspensions: Phenomenology, Mechanisms and Relations to Jamming. *Rep. Prog. Phys.* 2014, 77, 046602.
48. Waitukaitis, S. R.; Jaeger, H. M. Impact-Activated Solidification of Dense Suspensions via Dynamic Jamming Fronts. *Nature* 2012, 487, 205-209.
49. Lee, Y. S.; Wetzel, E. D.; Wagner, N. J. The Ballistic Impact Characteristics of Kevlar® Woven Fabrics Impregnated with a Colloidal Shear Thickening Fluid. *J. Mater. Sci.* 2003, 38, 2825-2833.
50. Gallier, S.; Lemaire, E.; Lobry, L.; Peters, F. Effect of Confinement in Wall-Bounded Non-Colloidal Suspensions. *J. Fluid Mech.* 2016, 799, 100-127.
51. Na, Y.; Cho, G. Sound Absorption and Viscoelastic Property of Acoustical Automotive Nonwovens and their Plasma Treatment. *Fibers Polym.* 2010, 11, 782-789.
52. Hettich, M.; Jacob, K.; Ristow, O.; Schubert, M.; Bruchhausen, A.; Gusev, V.; Dekorsy, T. Viscoelastic Properties and Efficient Acoustic Damping in Confined Polymer Nano-Layers At Ghz Frequencies. *Sci. Rep.* 2016, 6, 33471.
53. Wu, C. M.; Chou, M. H. Sound Absorption of Electrospun Polyvinylidene Fluoride/Graphene Membranes. *Eur. Polym. J.* 2016, 82, 35-45.
54. Wu, C. M.; Chou, M. H. Polymorphism, Piezoelectricity and Sound Absorption of Electrospun PVDF Membranes with and Without Carbon Nanotubes. *Compos. Sci. Technol.* 2016, 127, 127-133.
55. Si, Y.; Yu, J.; Tang, X.; Ge, J.; Ding, B. Ultralight Nanofibre-Assembled Cellular Aerogels with Superelasticity and Multifunctionality. *Nat. Commun.* 2014, 5, 5802.
56. Jarzynski, J., Mechanisms of Sound Attenuation in Materials. In *Sound and Vibration Damping with Polymers*, American Chemical Society: 1990; Chapter 10, pp 167-207.
57. Shin, Y. M.; Hohman, M. M.; Brenner, M. P.; Rutledge, G. C. Experimental Characterization of Electrospinning: The Electrically Forced Jet and Instabilities. *Polymer* 2001, 42, 09955-09967.
58. Theron, S. A.; Zussman, E.; Yarin, A. L. Experimental Investigation of the Governing Parameters in the Electrospinning of Polymer Solutions. *Polymer* 2004, 45, 2017-2030.
59. Thompson, C. J.; Chase, G. G.; Yarin, A. L.; Reneker, D. H. Effects of Parameters on Nanofiber Diameter Determined from Electrospinning Model. *Polymer* 2007, 48, 6913-6922.
60. Dhinojwala, A.; Bae, S. C.; Granick, S. Shear-Induced Dilation of Confined Liquid Films. *Tribol. Lett.* 2000, 9, 55-62.
61. Rosenhek-Goldian, I.; Kampf, N.; Yeredor, A.; Klein, J. On the Question of Whether Lubricants Fluidize in Stick-Slip Friction. *Proc. Natl. Acad. Sci. U.S.A.* 2015, 112, 7117-22.
62. Drummond, C.; Israelachvili, J. Dynamic Behavior of Confined Branched Hydrocarbon Lubricant Fluids under Shear. *Macromolecules* 2000, 33, 4910-4920.
63. Braun, O. M. Bridging the Gap Between the Atomic-Scale and Macroscopic Modeling of Friction. *Tribol. Lett.* 2010, 39, 283-293.

What is claimed is:

1. A fiber comprising:
a solid sheath comprising poly (caprolactone); and
a liquid core comprising a poly (ethylene glycol);
wherein the diameter of the liquid core is non-uniform along the length of the fiber.

2. The fiber of claim 1, wherein the fiber is made by electrospinning.

3. A mat comprising the electrospun fiber of claim 2.

4. The fiber of claim 1, wherein the fiber has a diameter of less than 10 microns.

5. The fiber of claim 1, wherein the liquid core further comprises silica particles.

6. A method comprising:
electrospinning a fiber comprising:
a solid sheath comprising poly (caprolactone); and
a liquid core comprising a poly (ethylene glycol);
wherein the diameter of the liquid core is non-uniform along the length of the fiber.

7. The method of claim 6, further comprising:
forming a mat of electrospun fibers formed by the method in claim 6.

8. The method of claim 6, wherein the fiber has a diameter of less than 10 microns.

9. The method of claim 6, wherein the liquid core further comprises silica particles.

* * * * *